US011452656B2

(12) United States Patent
Campbell et al.

(10) Patent No.: US 11,452,656 B2
(45) Date of Patent: Sep. 27, 2022

(54) SURGICAL TABLES AND METHODS OF OPERATING THE SAME

(71) Applicant: Eschmann Holdings Limited, Lancing (GB)

(72) Inventors: Julie Campbell, West Sussex (GB); Mark Portlock, West Sussex (GB); Matt Clayton, West Sussex (GB); Jeremy Hinton, West Sussex (GB); Richard Harding, West Sussex (GB)

(73) Assignee: Steris Solutions Limited, Leicester (GB)

( * ) Notice: Subject to any disclaimer, the term of this patent is extended or adjusted under 35 U.S.C. 154(b) by 93 days.

(21) Appl. No.: 16/756,762

(22) PCT Filed: Sep. 5, 2018

(86) PCT No.: PCT/EP2018/073816

§ 371 (c)(1),
(2) Date: Apr. 16, 2020

(87) PCT Pub. No.: WO2019/076526

PCT Pub. Date: Apr. 25, 2019

(65) Prior Publication Data

US 2021/0186789 A1 Jun. 24, 2021

(30) Foreign Application Priority Data

Oct. 18, 2017 (GB) ..... 1717123

(51) Int. Cl.
*A61G 13/04* (2006.01)
*A61G 13/06* (2006.01)

(52) U.S. Cl.
CPC ..... *A61G 13/04* (2013.01); *A61G 13/06* (2013.01)

(58) Field of Classification Search
CPC ..... A61G 13/02; A61G 13/04; A61G 13/06
See application file for complete search history.

(56) References Cited

U.S. PATENT DOCUMENTS 2,794,694 A * 6/1957 Fullwood ..... A61G 13/02 5/614
3,868,103 A * 2/1975 Pageot ..... A61G 13/02 5/614

(Continued)

FOREIGN PATENT DOCUMENTS

DE 2260140 A * 6/1974
EP 0086881 A1 * 8/1983 ..... A61G 13/02

(Continued)

OTHER PUBLICATIONS

International Search Report and Written Opinion in corresponding international application PCT/EP2018/073816 dated Feb. 4, 2019.

(Continued)

*Primary Examiner* — David R Hare
*Assistant Examiner* — Alexis Felix Lopez
(74) *Attorney, Agent, or Firm* — Polsinelli, P.C.

(57) ABSTRACT

A surgical table includes a base for standing on a floor; a column extending from the base; a tabletop providing a patient support surface; and a mechanism coupling the tabletop to the column and for enabling rotational movement of the tabletop relative to the column about two orthogonal axes, the mechanism having a first frame connected to the tabletop and a second frame connected to the column and rotatably mounted on the first frame about an axis that is orthogonal to both longitudinal and transverse directions of the tabletop. Also disclosed is a system for helping a user dispose a tabletop and a base of a surgical table at a predetermined relative position, a system for recording actions performed by a surgical table, and surgical tables (Continued)

configured to adjust a height of a tabletop thereof in specific manners.

44 Claims, 12 Drawing Sheets

(56) References Cited

U.S. PATENT DOCUMENTS

| | | | | |
|---|---|---|---|---|
| 5,285,995 | A * | 2/1994 | Gonzalez | G05D 19/02 248/550 |
| 5,398,356 | A * | 3/1995 | Pfleger | A61B 6/04 5/601 |
| 5,528,782 | A * | 6/1996 | Pfeuffer | A61G 13/02 108/147 |
| 5,621,933 | A * | 4/1997 | Knapp | A61G 7/018 5/607 |
| 6,640,363 | B1 * | 11/2003 | Pattee | A61G 13/04 5/601 |
| 8,215,199 | B2 * | 7/2012 | Marcroft | B25J 17/0216 74/490.08 |
| 10,206,841 | B2 * | 2/2019 | Soltermann | A61G 13/04 |
| 10,221,992 | B2 * | 3/2019 | Rushworth | B62D 57/032 |
| 10,816,335 | B2 * | 10/2020 | McMurtry | G01B 5/0016 |
| 10,874,433 | B2 * | 12/2020 | Mannanal | A61B 17/86 |
| 10,967,502 | B2 * | 4/2021 | Angood | B25J 9/1623 |
| 2002/0084389 | A1 * | 7/2002 | Larson | A47B 13/003 248/188.1 |
| 2012/0216350 | A1 * | 8/2012 | Koch | A61G 13/02 5/607 |
| 2013/0111668 | A1 | 5/2013 | Wiggers et al. | |
| 2016/0000620 | A1 * | 1/2016 | Koch | A61G 7/008 5/608 |
| 2016/0331477 | A1 | 11/2016 | Yu et al. | |
| 2018/0193216 | A1 * | 7/2018 | Soltermann | A61G 13/04 |

FOREIGN PATENT DOCUMENTS

| | | | | |
|---|---|---|---|---|
| EP | 1161929 | A2 * | 12/2001 | A61G 13/02 |
| FR | 3083695 | A1 * | 1/2020 | A61G 13/06 |
| WO | WO-0172226 | A1 * | 10/2001 | A61G 13/121 |
| WO | 2002/32312 | A1 | 4/2002 | |
| WO | WO-0232312 | A1 * | 4/2002 | A61B 6/0487 |
| WO | WO-2020064902 | A1 * | 4/2020 | A61G 13/06 |

OTHER PUBLICATIONS

Combined Search and Examination Report under Sections 17 and 18(3) issued in corresponding GB application No. 1717123.2 dated Apr. 11, 2018.

* cited by examiner

SURGICAL TABLES AND METHODS OF OPERATING THE SAME

FIELD OF THE INVENTION

The present invention relates to surgical tables and to methods of operating surgical tables.

BACKGROUND

Surgical tables, or operating tables, comprising a base for standing on a floor, a column extending from the base, and a tabletop providing a patient support surface are well known.

SUMMARY OF THE INVENTION

In order for surgical tables to be versatile, it is necessary for the tabletop to be disposable in a variety of different configurations. WO2003/030802 discloses a surgical table with mechanisms for inclining a tabletop of the table relative to a column of the table and relative to the horizontal about both transverse and longitudinal axes of the tabletop, and a drive assembly for permitting a traverse movement of the tabletop relative to the column in back and forth longitudinal directions of the tabletop.

There is a need for a surgical table with a mechanism for inclining a tabletop of the table over a greater range of angles about two orthogonal axes, in order to increase the versatility of the table.

Inclination of a tabletop of a surgical table is usually effected by operating one or more actuators connected between the tabletop and a column of the surgical table. The actuator(s) need to be robust to withstand loads to which they are subjected when a patient is present on the tabletop.

There is a need for a surgical table with a mechanism for inclining a tabletop of the table relative to a column of the table that requires less robust actuators.

Some known surgical tables allow for a height of a tabletop thereof relative to a base thereof to be adjusted.

There is a need for a surgical table with an alternative mechanism for adjusting a height of a tabletop thereof.

Surgical tables may have a tabletop and a base that are movable relative to each other between first and second relative positions via a predetermined relative position, such as a predetermined default or home position. Such a predetermined relative position may be, for example, the position at which a patient is most easily transferrable onto or from the table, or the position at which the tabletop and the base are best placed to enable a certain procedure to be performed on a patient supported by the table.

There is a need for a surgical table having an assistance mechanism for helping medical staff using the surgical table to dispose a tabletop and a base of the surgical table at such a predetermined relative position.

Surgical tables often have first and second parts that are movable relative to each other by operating one or more electric actuators connected between the first and second parts.

There is a need for a surgical table having a system for monitoring the state of one or more electric actuators of the table.

There also is a need for a surgical table having a system for monitoring relative movements of first and second parts of the table, such as for future determination of relative movements of the first and second parts that have taken place.

A first aspect of the present invention provides a surgical table comprising: a base for standing on a floor; a column extending from the base; a tabletop providing a patient support surface; a mechanism coupling the tabletop to the column and for enabling rotational movement of the tabletop relative to the column about two orthogonal axes, wherein one of the two orthogonal axes is parallel to the longitudinal direction of the tabletop and the other of the two orthogonal axes is parallel to the transverse direction of the tabletop, the mechanism comprising a first frame connected to the tabletop and a second frame connected to the column and rotatably mounted on the first frame about an axis that is orthogonal to both longitudinal and transverse directions of the tabletop, and first and second actuators, each actuator being connected to a respective one of the frames for moving the respective frame about a respective one of the two orthogonal axes, wherein the first frame is connected to the column via the first actuator, and the second frame is connected to the column via the second actuator.

In a preferred embodiment of the surgical table, the first frame is connected to the first actuator by a first gimbal mechanism and the second frame is connected to the second actuator by a second gimbal mechanism.

Preferably, the first gimbal mechanism is configured to rotate the tabletop about an axis parallel to the transverse direction of the tabletop (i.e. in a Trendelenburg or reverse Trendelenburg movement) and the second gimbal mechanism is configured to rotate the tabletop about an axis parallel to the longitudinal direction of the tabletop (i.e. in a tilt movement in either a left or right direction relative to the longitudinal direction of the tabletop).

Optionally, each of the first and second actuators is for moving both of the frames about a respective one of the two orthogonal axes.

Optionally, the first frame is connected to the column via the first actuator and via a third actuator in parallel to the first actuator.

Optionally, the total number of actuators via which the first frame is connected to the column is only two.

Optionally, the first and third actuators are connected to opposed sides of the column.

Optionally, each of the first and third actuators is connected to a respective one of two opposite end portions of the first frame.

Optionally, the total number of actuators via which the second frame is connected to the column is only one.

Optionally, one or each of the first and second actuators is connected to the respective frame via a universal joint.

Optionally, the third actuator is connected to the first frame via a universal joint.

Optionally, one or each of the first and second actuators is rotatably connected to the column about only a single axis.

Optionally, the first actuator is rotatably connected to the column about a first axis and the second actuator is rotatably connected to the column about a second axis, wherein the second axis is orthogonal to the first axis.

Optionally, one of the first and second axes is parallel to the longitudinal direction of the tabletop and the other of the first and second axes is parallel to the transverse direction of the tabletop.

Optionally, one or each of the first and third actuators is rotatably connected to the column about only a single axis.

Optionally, the first actuator is rotatably connected to the column about a first axis and the third actuator is rotatably connected to the column about a third axis, wherein the third axis is spaced from and parallel to the first axis.

Optionally, each of the first and second actuators comprises a cylinder connected to one of the column and the respective frame, and an elongate part movably disposed within the cylinder and connected to the other of the column and the respective frame.

Optionally, the third actuator comprises a cylinder connected to one of the column and the first frame, and an elongate part movably disposed within the cylinder and connected to the other of the column and the first frame.

Optionally, each of the first, second and third actuators is extendible, and extension of all of the first, second and third actuators increases the height of the mechanism thereby increasing a height of the tabletop above the column.

Optionally, the surgical table comprises first and second extensible stabilisers, wherein the first frame is connected to the column via the first extensible stabiliser in parallel with the first actuator, and the second frame is connected to the column via the second extensible stabiliser in parallel with the second actuator. Further optionally, the first and second actuators are connected to the respective first and second frames via respective first and second universal joints, and wherein the first and second extensible stabilisers are connected to the respective first and second frames via the respective first and second universal joints.

Optionally, the total number of extensible stabilisers via which the first frame is connected to the column is only two, and the total number of extensible stabilisers via which the second frame is connected to the column is only two.

A second aspect of the present invention provides a surgical table comprising: a base for standing on a floor; a column extending from the base; a tabletop providing a patient support surface; and a mechanism coupling the tabletop to the column and for enabling rotational movement of the tabletop relative to the column about two orthogonal axes, the mechanism comprising a first frame connected to the tabletop, a second frame rotatably mounted on the first frame, first and second extensible stabilisers, and first and second actuators disposed outside of both the first and second extensible stabilisers, each actuator being connected to a respective one of the frames for moving the respective frame about a respective one of the two orthogonal axes; wherein the first frame is connected to the column via the first extensible stabiliser and the first actuator in parallel, and the second frame is connected to the column by the second extensible stabiliser and the second actuator in parallel.

Optionally, the second frame is rotatably mounted on the first frame about an axis that is orthogonal to both longitudinal and transverse directions of the tabletop.

Optionally, one of the two orthogonal axes is parallel to a longitudinal direction of the tabletop and the other of the two orthogonal axes is parallel to a transverse direction of the tabletop.

Optionally, one or each of the first and second extensible stabilisers comprises a cylinder connected to one of the column and the respective frame, and an elongate part movably disposed within the cylinder and connected to the other of the column and the respective frame.

Optionally, one or each of the first and second actuators is rotatably connected to the column about only a single axis.

Optionally, the first actuator is rotatably connected to the column about a first axis and the second actuator is rotatably connected to the column about a second axis, wherein the second axis is orthogonal to the first axis.

Optionally, one of the first and second axes is parallel to a longitudinal direction of the tabletop and the other of the first and second axes is parallel to a transverse direction of the tabletop.

Optionally, one or each of the first and second extensible stabilisers is rotatably connected to the column about only a single axis.

Optionally, the first extensible stabiliser is rotatably connected to the column about the first axis or an axis parallel to the first axis, and the second extensible stabiliser is rotatably connected to the column about the second axis or an axis parallel to the second axis.

Optionally, the first actuator is connected to the first frame via a first universal joint. Further optionally, the first extensible stabiliser is connected to the first frame via the first universal joint.

Optionally, the second actuator is connected to the second frame via a second universal joint. Further optionally, the second extensible stabiliser is connected to the second frame via the second universal joint.

Optionally, in the surgical table of the first aspect or of the second aspect, the column is of adjustable height.

Optionally, in the surgical table of the first aspect or of the second aspect, the first frame is connected to the tabletop via a tabletop traverse mechanism for enabling movement of the tabletop relative to the column in a selected longitudinal direction of the tabletop.

A third aspect of the present invention provides a surgical table comprising: a base for standing on a floor, a column extending from the base and having a height that is adjustable between a minimum height and a maximum height, a tabletop providing a patient support surface, a mechanism of adjustable height coupling the tabletop to the column, a mechanism height adjustment system for adjusting the height of the mechanism, and a controller configured to control the mechanism height adjustment system to adjust the height of the mechanism only when the height of the column is one of the minimum height and the maximum height.

Optionally, the surgical table comprises a column height adjustment system for adjusting the height of the column between the minimum height and the maximum height, wherein the controller is configured to control the column height adjustment system.

A fourth aspect of the present invention provides a surgical table comprising: a base for standing on a floor, a column extending from the base and having a height that is adjustable between a first minimum height and a first maximum height, a tabletop providing a patient support surface, a mechanism coupling the tabletop to the column and having a height that is adjustable between a second minimum height and a second maximum height, a column height adjustment system for adjusting the height of the column between the first minimum height and the first maximum height, a mechanism height adjustment system for adjusting the height of the mechanism between the second minimum height and the second maximum height, and a controller configured to control the column height adjustment system to adjust the height of the column and then to control the mechanism height adjustment system to adjust the height of the mechanism, in order to adjust a height of the tabletop above the base.

Optionally, the controller is configured to adjust the height of the column to one of the first minimum height and the first maximum height and then to control the mechanism height adjustment system to adjust the height of the mechanism, in order to adjust a height of the tabletop above the base. Further optionally, the controller is configured to control the mechanism height adjustment system to adjust the height of the mechanism, then to control the column height adjustment system to adjust the height of the column to one of the first minimum height and the first maximum height, and then to control the mechanism height adjustment system to further adjust the height of the mechanism, in order to adjust a height of the tabletop above the base. Still further optionally, the controller is configured to control the mechanism height adjustment system to adjust the height of the mechanism to a height between the second minimum height and the second maximum height, then to control the column height adjustment system to adjust the height of the column to one of the first minimum height and the first maximum height, and then to control the mechanism height adjustment system to adjust the height of the mechanism to one of the second minimum height and the second maximum height, in order to adjust a height of the tabletop above the base.

Optionally, in the surgical table of the third aspect or of the fourth aspect, the column comprises a first part connected to one of the base and the mechanism, and a second part movably disposed within the first part and connected to the other of the base and the mechanism.

Optionally, in the surgical table of the third aspect or of the fourth aspect, the column height adjustment system is for causing relative movement of the first and second parts.

Optionally, in the surgical table of the third aspect or of the fourth aspect, the mechanism is for enabling rotational movement of the tabletop relative to the column about two orthogonal axes. Further optionally, one of the two orthogonal axes is parallel to a longitudinal direction of the tabletop and the other of the two orthogonal axes is parallel to a transverse direction of the tabletop.

Optionally, in the surgical table of the third aspect or of the fourth aspect, the mechanism comprises a first frame connected to the tabletop and a second frame connected to the column and rotatably mounted on the first frame about an axis that is orthogonal to both longitudinal and transverse directions of the tabletop. Further optionally, the surgical table of the third aspect or of the fourth aspect comprises first and second actuators, each actuator being connected to a respective one of the frames for moving the respective frame about a respective one of the two orthogonal axes, wherein the first frame is connected to the column via the first actuator, and the second frame is connected to the column via the second actuator. Still further optionally, the first frame is connected to the column via the first actuator and via a third actuator in parallel to the first actuator. Yet further optionally, each of the first, second and third actuators is extendible, and extension of all of the first, second and third actuators increases the height of the mechanism thereby increasing a height of the tabletop above the column.

A fifth aspect of the present invention provides a surgical table comprising: a base for standing on a floor; a column extending from the base; a tabletop coupled to the column and providing a patient support surface; a tabletop drive mechanism for causing relative translational movement of the tabletop and the base; and a controller for controlling operation of the tabletop drive mechanism; wherein the controller is configured to control the tabletop drive mechanism to cause relative translational movement of the tabletop and the base between first and second relative positions via a predetermined relative position, and configured to control the tabletop drive mechanism to cause the relative translational movement of the tabletop and the base to be paused for a predetermined period of time when the tabletop and the base are at the predetermined relative position.

Optionally, the tabletop drive mechanism is for adjusting a height of the column, and the movement comprises translational movement of the tabletop towards or away from the base.

Optionally, the movement comprises translational movement of the tabletop in a longitudinal direction of the tabletop relative to the base.

Optionally, the surgical table comprises a sensor for sensing, and for notifying the controller of, a relative position of the tabletop and the base. Further optionally, the sensor is for sensing, and for notifying the controller of, when the tabletop and the base are at the predetermined relative position.

Optionally, the predetermined period of time is between 0.05 and 5 seconds. Further optionally, the predetermined period of time is between 0.1 and 3 seconds. Further optionally, the predetermined period of time is between 0.25 and 2 seconds.

A sixth aspect of the present invention provides a method of operating a surgical table comprising a base for standing on a floor, a column extending from the base, a tabletop coupled to the column and providing a patient support surface, a tabletop drive mechanism for causing relative translational movement of the tabletop and the base, and a controller for controlling operation of the tabletop drive mechanism, the method comprising: the controller controlling the tabletop drive mechanism to cause relative translational movement of the tabletop and the base between first and second relative positions via a predetermined relative position; and the controller controlling the tabletop drive mechanism to cause the relative translational movement of the tabletop and the base to be paused for a predetermined period of time when the tabletop and the base are at the predetermined relative position.

Optionally, the tabletop drive mechanism is for adjusting a height of the column, and the movement comprises translational movement of the tabletop towards or away from the base.

Optionally, the movement comprises translational movement of the tabletop in a longitudinal direction of the tabletop relative to the base.

Optionally, the method comprises sensing a relative position of the tabletop and the base. Further optionally, the method comprises sensing when the tabletop and the base are at the predetermined relative position.

Optionally, the predetermined period of time is between 0.05 and 5 seconds. Further optionally, the predetermined period of time is between 0.1 and 3 seconds. Further optionally, the predetermined period of time is between 0.25 and 2 seconds.

A seventh aspect of the present invention provides a surgical table comprising: a base for standing on a floor, a column extending from the base and having a height that is adjustable between a first minimum height and a first maximum height, a difference between the first minimum height and the first maximum height being a first range, a tabletop providing a patient support surface, and a mechanism coupling the tabletop to the column and having a height that is adjustable between a second minimum height and a second maximum height, a difference between the second minimum height and the second maximum height being a second range, wherein the first range is greater than the second range.

Optionally, a ratio of the first range to the second range is between 1.25:1 and 4:1. Further optionally, the ratio of the first range to the second range is between 2:1 and 3:1.

Optionally, the first range is between 400 and 600 millimeters and the second range is between 100 and 300 millimeters.

Optionally, the column comprises a first part connected to one of the base and the mechanism, and a second part movably disposed within the first part and connected to the other of the base and the mechanism.

Optionally, the mechanism is for enabling rotational movement of the tabletop relative to the column about two orthogonal axes. Further optionally, one of the two orthogonal axes is parallel to a longitudinal direction of the tabletop and the other of the two orthogonal axes is parallel to a transverse direction of the tabletop.

Optionally, the mechanism comprises a first frame connected to the tabletop and a second frame connected to the column and rotatably mounted on the first frame about an axis that is orthogonal to both longitudinal and transverse directions of the tabletop. Further optionally, the surgical table comprises first and second actuators, each actuator being connected to a respective one of the frames for moving the respective frame about a respective one of the two orthogonal axes, wherein the first frame is connected to the column via the first actuator, and the second frame is connected to the column via the second actuator. Still further optionally, the first frame is connected to the column via the first actuator and via a third actuator in parallel to the first actuator. Yet further optionally, each of the first, second and third actuators is extendible, and extension of all of the first, second and third actuators increases the height of the mechanism thereby increasing a height of the tabletop above the column.

An eighth aspect of the present invention provides a surgical table comprising: first and second relatively movable parts, a drive mechanism comprising an electric actuator for causing relative movement of the first and second parts, a power supply for the electric actuator, a current determiner for determining a current drawn from the power supply by the electric actuator, a memory, and a recorder communicatively connected to the current determiner and the memory and configured to record in the memory an indication of the determined current in dependence on an output of the current determiner.

Optionally, the current determiner is for determining a current drawn from the power supply by the electric actuator while the electric actuator causes relative movement of the first and second parts.

Optionally, the current determiner is for determining respective currents drawn from the power supply by the electric actuator at respective different times, and the recorder is configured to record in the memory respective indications of the determined respective currents.

Optionally, the surgical table comprises a calculator configured to calculate a cumulative current drawn from the power supply by the electric actuator over a period of time.

Optionally, the surgical table comprises an overload determiner for determining when the electric actuator is overloaded in dependence on an output of one of the current determiner and the recorder or in dependence on a content of the memory. Further optionally, the surgical table comprises an indicator for indicating to a user when the electric actuator is overloaded in dependence on an output of the overload determiner.

Optionally, the surgical table comprises a base for standing on a floor, a column extending from the base, and a tabletop coupled to the column and providing a patient support surface, wherein the first part comprises the tabletop and the second part comprises one of the column and the base.

A ninth aspect of the present invention provides a method of operating a surgical table comprising first and second relatively movable parts, a drive mechanism comprising an electric actuator for causing relative movement of the first and second parts, a power supply for the electric actuator, a current determiner for determining a current drawn from the power supply by the electric actuator, a memory, and a recorder communicatively connected to the current determiner and the memory and configured to record in the memory an indication of the determined current in dependence on an output of the current determiner; the method comprising: the current determiner determining a current drawn from the power supply by the electric actuator; and the recorder recording in the memory an indication of the determined current in dependence on an output of the current determiner.

Optionally, the method comprises the current determiner determining a current drawn from the power supply by the electric actuator while the electric actuator causes relative movement of the first and second parts.

Optionally, the method comprises the current determiner determining respective currents drawn from the power supply by the electric actuator at respective different times, and the recorder recording in the memory respective indications of the determined respective currents.

Optionally, the surgical table comprises a calculator, and the method comprises the calculator calculating a cumulative current drawn from the power supply by the electric actuator over a period of time.

Optionally, the surgical table comprises an overload determiner, and the method comprises the overload determiner determining when the electric actuator is overloaded in dependence on an output of one of the current determiner and the recorder or in dependence on a content of the memory. Further optionally, the surgical table comprises an indicator, and the method comprises the indicator indicating to a user when the electric actuator is overloaded in dependence on an output of the overload determiner.

Optionally, the surgical table comprises a base for standing on a floor, a column extending from the base, and a tabletop coupled to the column and providing a patient support surface, and wherein the first part comprises the tabletop and the second part comprises one of the column and the base.

A tenth aspect of the present invention provides a surgical table comprising: first and second relatively movable parts, a drive mechanism for causing relative movement of the first and second parts, a non-contact movement determiner for determining a relative movement of the first and second parts, a memory, and a recorder communicatively connected to the movement determiner and the memory and configured to record in the memory an indication of the detected relative movement in dependence on an output of the movement determiner.

Optionally, the surgical table comprises a controller for controlling the drive mechanism, wherein the movement determiner is communicatively connected to the controller and is configured to determine a relative movement of the first and second parts on the basis of an output of the controller.

Optionally, the surgical table comprises a sensor for sensing a relative position of the first and second parts, wherein the movement determiner is communicatively connected to the sensor and is configured to determine a relative movement of the first and second parts on the basis of an output of the sensor.

Optionally, the movement determiner is for determining respective relative movements of the first and second parts at respective different times, and the recorder is configured to record in the memory respective indications of the determined respective relative movements.

Optionally, the surgical table comprises third and fourth relatively movable parts, a drive mechanism for causing second relative movement of the third and fourth parts, wherein the movement determiner is for determining a second relative movement of the third and fourth parts, and wherein the recorder is configured to record in the memory an indication of the detected second relative movement in dependence on an output of the movement determiner. Further optionally, the surgical table comprises an indicator for indicating to a user, in dependence on a content of the memory, (a) a sequence of past relative movements of the first and second parts and/or of the third and fourth parts, and/or (b) a last-performed relative movement of the first and second parts and/or of the third and fourth parts.

Optionally, the surgical table comprises a base for standing on a floor, a column extending from the base, and a tabletop coupled to the column and providing a patient support surface, wherein the first part comprises one of the tabletop and a part of the column and the second part comprises one of the column and the base.

An eleventh aspect of the present invention provides a method of operating a surgical table comprising first and second relatively movable parts, a drive mechanism for causing relative movement of the first and second parts, a non-contact movement determiner for determining a relative movement of the first and second parts, a memory, and a recorder communicatively connected to the movement determiner and the memory and configured to record in the memory an indication of the detected relative movement in dependence on an output of the movement determiner; the method comprising: the movement determiner determining a relative movement of the first and second parts; and the recorder recording in the memory an indication of the detected relative movement in dependence on an output of the movement determiner.

Optionally, the surgical table comprises a controller for controlling the drive mechanism, wherein the movement determiner is communicatively connected to the controller, and the method comprises the movement determiner determining a relative movement of the first and second parts on the basis of an output of the controller.

Optionally, the surgical table comprises a sensor for sensing a relative position of the first and second parts, wherein the movement determiner is communicatively connected to the sensor, and the method comprises the movement determiner determining a relative movement of the first and second parts on the basis of an output of the sensor.

Optionally, the method comprises the movement determiner determining respective relative movements of the first and second parts at respective different times, and the recorder recording in the memory respective indications of the determined respective relative movements.

Optionally, the surgical table comprises third and fourth relatively movable parts, a drive mechanism for causing second relative movement of the third and fourth parts, and the method comprises the movement determiner determining a second relative movement of the third and fourth parts, and the recorder recording in the memory an indication of the detected second relative movement in dependence on an output of the movement determiner.

Optionally, the surgical table comprises an indicator, and the method comprises the indicator indicating to a user, in dependence on a content of the memory, (a) a sequence of past relative movements of the first and second parts and/or of the third and fourth parts, and/or (b) a last-performed relative movement of the first and second parts and/or of the third and fourth parts.

Optionally, the surgical table comprises a base for standing on a floor, a column extending from the base, and a tabletop coupled to the column and providing a patient support surface, wherein the first part comprises one of the tabletop and a part of the column and the second part comprises one of the column and the base.

A twelfth aspect of the present invention provides a surgical table comprising: first and second relatively movable parts; a mechanism coupling the first part to the second part, the mechanism comprising an extensible stabiliser and an actuator disposed outside of the extensible stabiliser, wherein the first part is connected to the second part via the extensible stabiliser and the actuator in parallel; a sensor comprised in the extensible stabiliser; and a controller configured to control the actuator to adjust a length of the actuator on the basis of an output of the sensor.

Optionally, the table comprises a base for standing on a floor; a column extending from the base; and a tabletop providing a patient support surface, wherein the first part is the tabletop and the second part is the column.

Optionally, the extensible stabiliser comprises a magnet, and the sensor comprises one of a hall effect sensor and a reed switch configured to detect a magnetic field of the magnet. Further optionally, the extensible stabiliser comprises a cylinder and an elongate part movably disposed within the cylinder, wherein the sensor is comprised in one of the cylinder and the elongate part, and the magnet is comprised in the other of the cylinder and the elongate part.

A thirteenth aspect of the present invention provides a surgical table comprising: a base for standing on a floor; a column extending from the base; a tabletop providing a patient support surface; and a mechanism coupling the tabletop to the column and for enabling rotational movement of the tabletop relative to the column about two orthogonal axes, the mechanism comprising a first frame connected to the tabletop, a second frame rotatably mounted on the first frame, an extensible stabiliser, and first, second and third actuators disposed outside of the extensible stabiliser, each of the first and second actuators being connected to a respective one of the frames for moving the respective frame about a respective one of the two orthogonal axes; wherein the first frame is connected to the column via the first and third actuators in parallel, and the second frame is connected to the column by the extensible stabiliser and second actuator in parallel; and wherein the total number of actuators via which the first frame is connected to the column is only two, and the total number of actuators via which the second frame is connected to the column is only one.

Optionally, the second frame is rotatably mounted on the first frame about an axis that is orthogonal to both longitudinal and transverse directions of the tabletop.

Optionally, one of the two orthogonal axes is parallel to a longitudinal direction of the tabletop and the other of the two orthogonal axes is parallel to a transverse direction of the tabletop.

Optionally, the first actuator is rotatably connected to the column about a first axis and the second actuator is rotatably connected to the column about a second axis, wherein the second axis is orthogonal to the first axis.

Optionally, one of the first and second axes is parallel to a longitudinal direction of the tabletop and the other of the first and second axes is parallel to a transverse direction of the tabletop.

Optionally, the third actuator is rotatably connected to the column about an axis parallel to the first axis.

Optionally, the extensible stabiliser is rotatably connected to the column about an axis parallel to the second axis.

As described above, in a preferred embodiment of the surgical table, the first frame is connected to the first actuator by a first gimbal mechanism and the second frame is connected to the second actuator by a second gimbal mechanism. Preferably, the first gimbal mechanism is configured to rotate the tabletop about an axis parallel to the transverse direction of the tabletop (i.e. in a Trendelenburg or reverse Trendelenburg movement) and the second gimbal mechanism is configured to rotate the tabletop about an axis parallel to the longitudinal direction of the tabletop (i.e. in a tilt movement in either a left or right direction relative to the longitudinal direction of the tabletop).

The provision of such a rotatable mounting between the first and second frames which have respective gimbal mechanisms to cause trend and tilt movement, respectively and independently, of the tabletop provides high angles of trend and tilt movement about the respective axes.

Also, this rotatable mounting can avoid the provision of any sliding joint between the trend and tilt actuators and the tabletop.

In addition, the trend and tilt actuators can provide a secondary height extension for the tabletop relative to the column, i.e. raise and lower the tabletop relative to the column.

Furthermore, in the preferred embodiment, there are two trend actuators rotatably connected to respective opposite sides of the first frame for independently rotating the first frame about the trend axis and the combination of a single tilt actuator and an extensible stabiliser rotatably connected to respective opposite sides of the second frame for independently rotating the second frame about the tilt axis. The actuators are driven and are active, whereas the extensible stabiliser is undriven and is passive.

The driven actuators typically have very limited slack, whereas the extensible stabiliser has a high degree of slack as it is undriven.

By providing two opposite actuators for rotating the tabletop about the trend axis, high trend loads can be carried by the opposite trend actuators. The tilt load of a tabletop is generally lower than the trend load, and consequently a single tilt actuator can be employed, in combination with an opposite passive extensible stabiliser. This lowers the cost and complexity of the tilt and trend mechanism.

Moreover, by providing only three actuators, two for trend and one for tilt, this minimises the possibility of the tilt and trend mechanism being subjected to excessive loads and/or locking up. Actuators used in surgical tables, such as leadscrews and ballscrews, tend to have a small tolerance of movement and typically exhibit some small positioning error. If there were two pairs of driven actuators, two for trend and two for tilt, there is a likelihood that the positioning errors may cumulatively cause excessive stress on the actuators, and wear, failure or locking up of the tilt and trend mechanism, since the cumulative positioning errors could not be accommodated in a drive system with little freedom of movement.

In contrast, in the preferred embodiment of the surgical table of the present invention there is one pair of driven actuators for trend, and the combination of a driven actuator and a passive extensible stabiliser for tilt. The passive extensible stabiliser, which has a high freedom of movement, can accommodate any cumulative positioning errors, thereby reducing excessive stress on the actuators, and minimising the risk of wear, failure or locking up of the tilt and trend mechanism.

BRIEF DESCRIPTION OF THE DRAWINGS

Preferred embodiments of the present invention will now be described by way of example only with reference to the accompanying drawings, in which.

DETAILED DESCRIPTION

Figure 1:
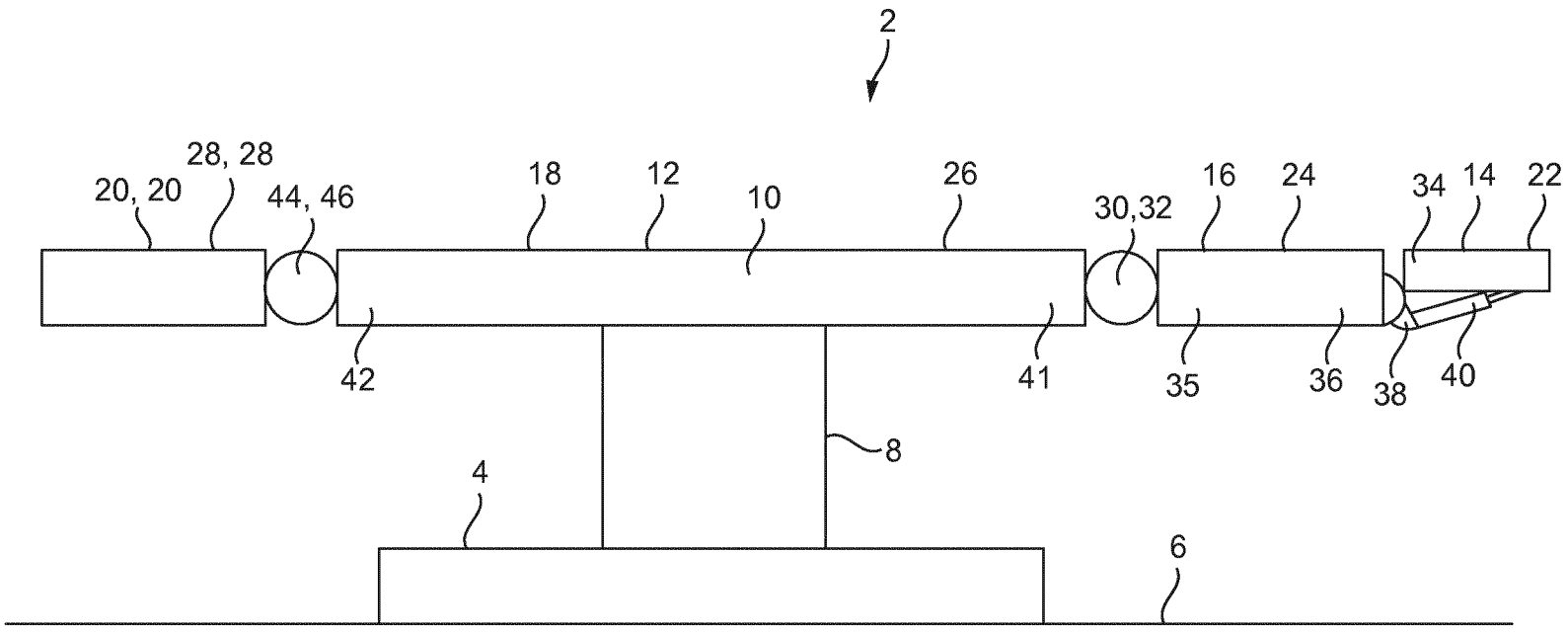
—FIG. 1 is a schematic side view of a surgical table in accordance with an embodiment of the present invention.
Figure 2A:
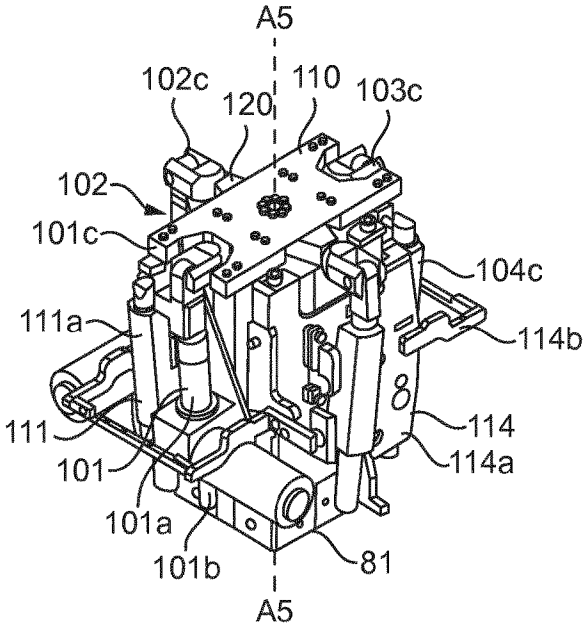
FIG. 2A is a perspective view of a column and a mechanism for coupling a tabletop to the column of the surgical table of FIG. 1, with the mechanism at its minimum height.
Figure 2D:
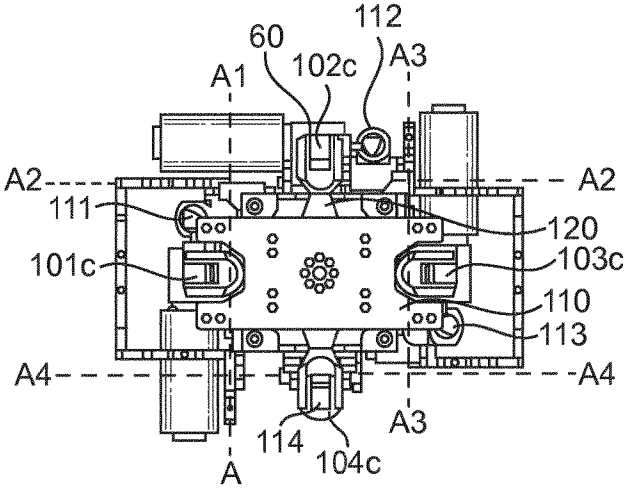
FIGS. 2B to 2D are a side view, an end view and a top plan view, respectively, of the components shown in FIG. 2A.
Figure 2B:
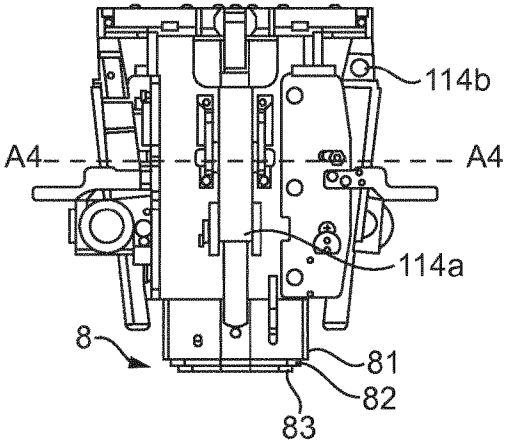
Figure 2C:
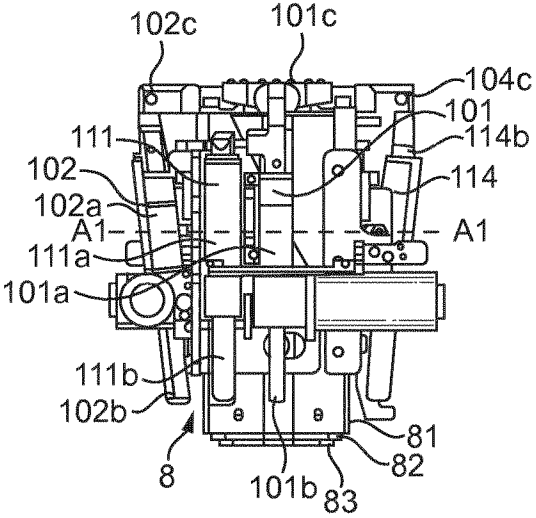
Figure 3A:
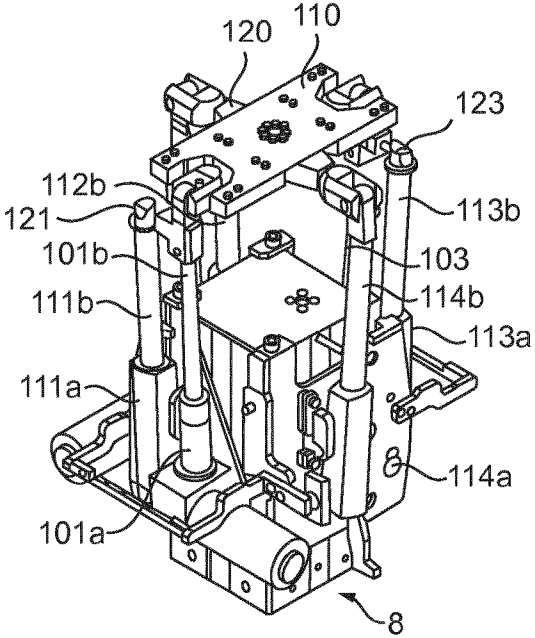
FIG. 3A is a perspective view of the column and the mechanism for coupling the tabletop to the column of the surgical table of FIG. 1, with the mechanism at its maximum height.
Figure 3D:
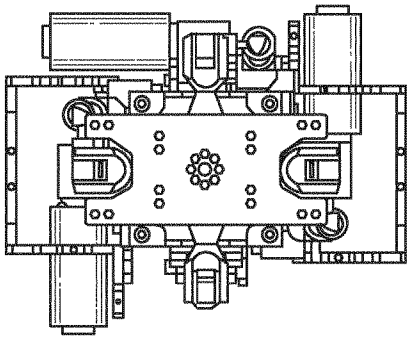
FIGS. 3B to 3D are a side view, an end view and a top plan view, respectively, of the components shown in FIG. 3A.
Figure 3B:
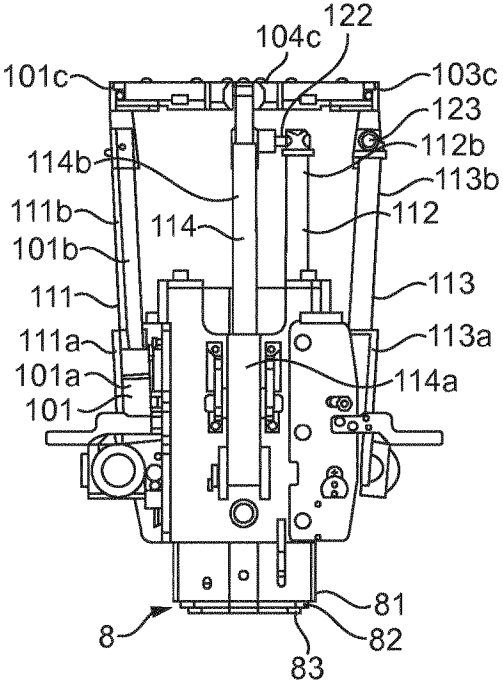
Figure 3C:
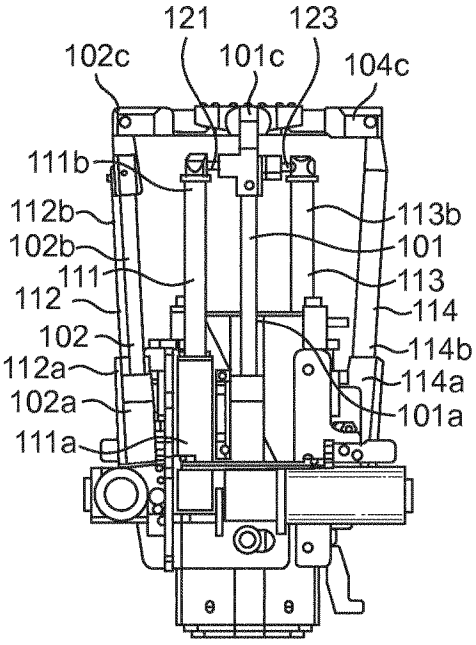
Figure 4A:
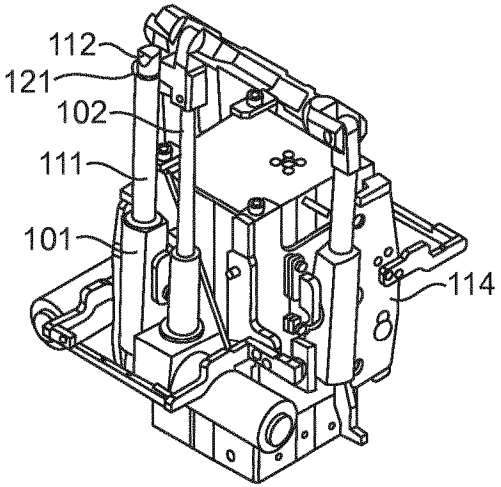
FIG. 4A is a perspective view of the column and the mechanism for coupling the tabletop to the column of the surgical table of FIG. 1, with the mechanism in a position for causing the tabletop to assume a maximum Trendelenburg position.
Figure 4D:
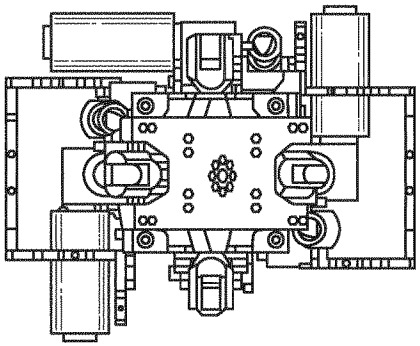
FIGS. 4B to 4D are a side view, an end view and a top plan view, respectively, of the components shown in FIG. 4A.
Figure 4B:
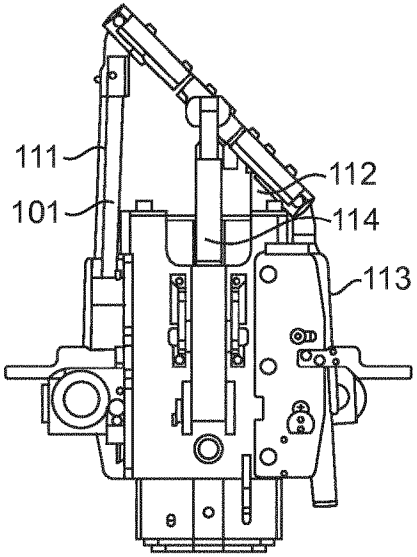
Figure 4C:
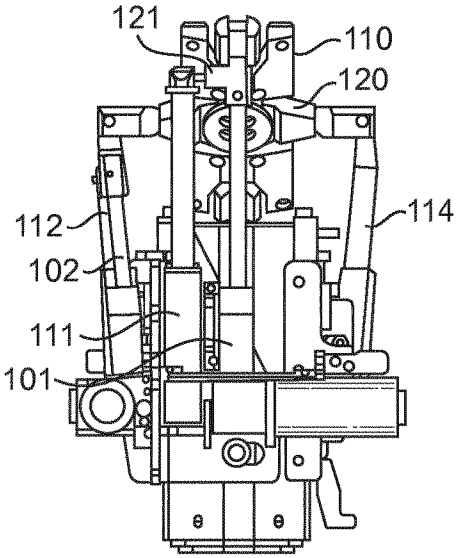
Figure 5A:
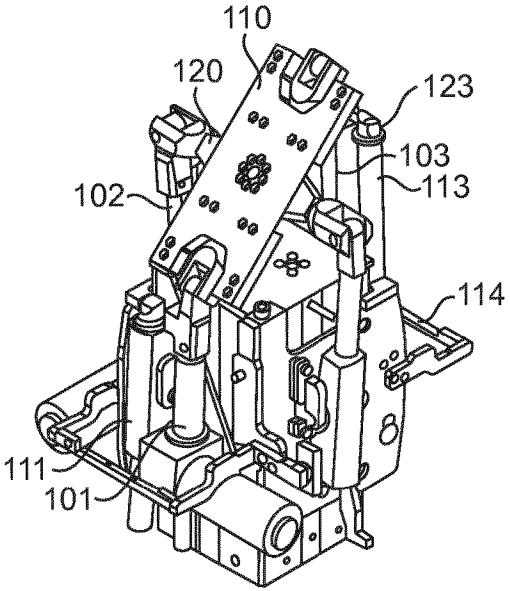
FIG. 5A is a perspective view of the column and the mechanism for coupling the tabletop to the column of the surgical table of FIG. 1, with the mechanism in a position for causing the tabletop to assume a maximum reverse-Trendelenburg position.
Figure 5D:
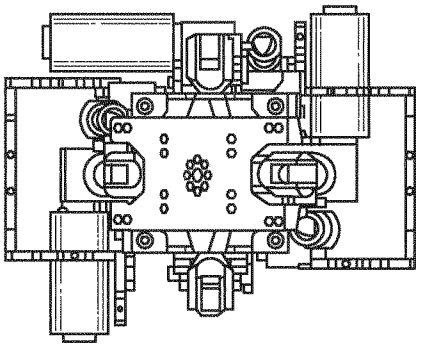
FIGS. 5B to 5D are a side view, an end view and a top plan view, respectively, of the components shown in FIG. 5A.
Figure 5B:
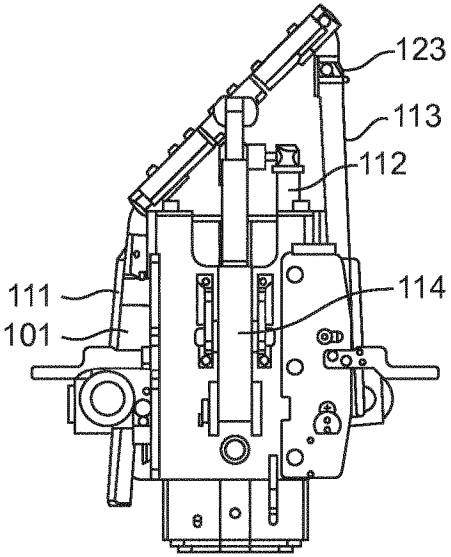
Figure 5C:
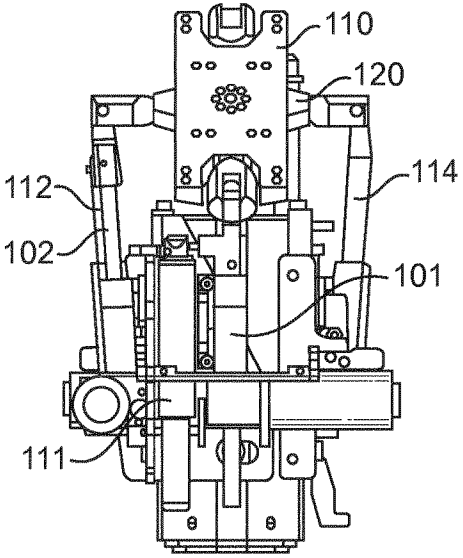
Figure 6A:
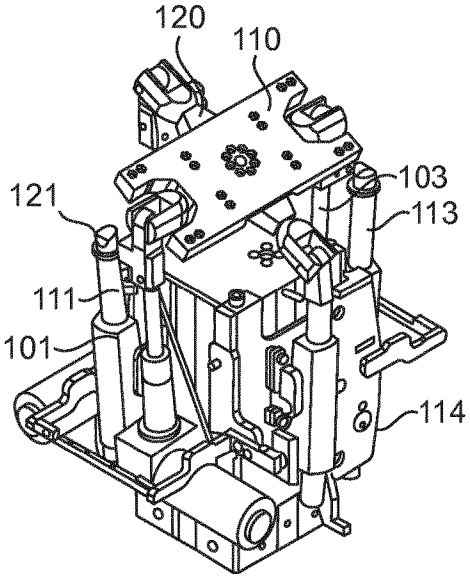
FIG. 6A is a perspective view of the column and the mechanism for coupling the tabletop to the column of the surgical table of FIG. 1, with the mechanism in a position for causing the tabletop to assume a maximum left hand tilt.
Figure 6D:
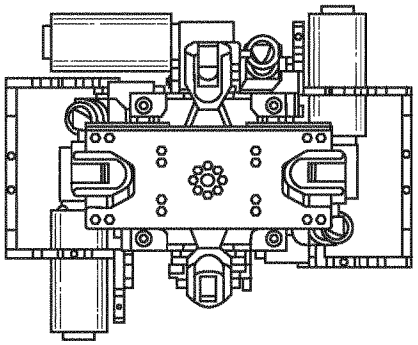
FIGS. 6B to 6D are a side view, an end view and a top plan view, respectively, of the components shown in FIG. 6A.
Figure 6B:
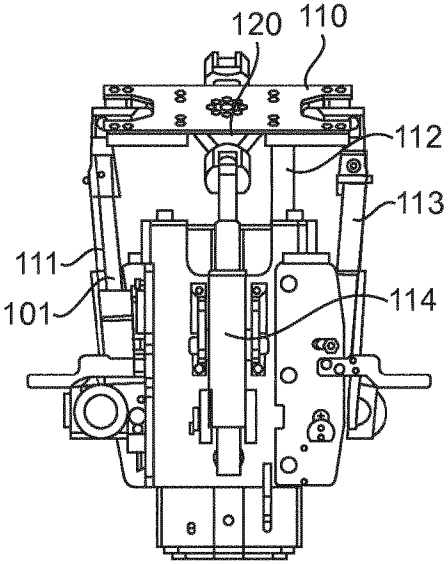
Figure 6C:
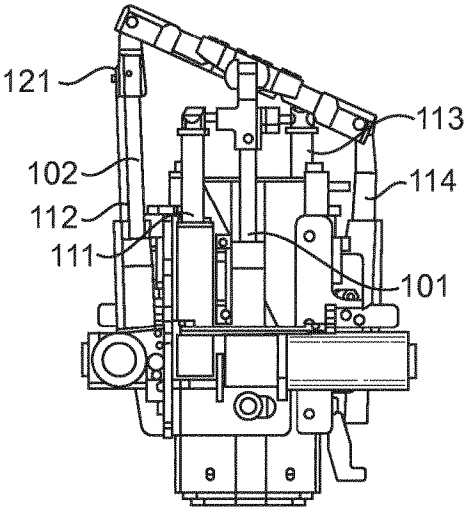
Figure 7A:
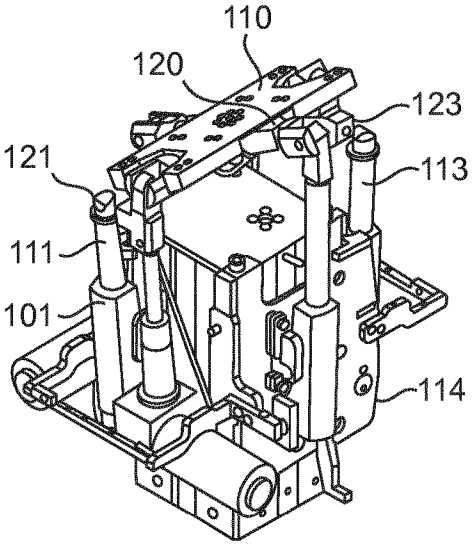
FIG. 7A is a perspective view of the column and the mechanism for coupling the tabletop to the column of the surgical table of FIG. 1, with the mechanism in a position for causing the tabletop to assume a maximum right hand tilt.
Figure 7B:
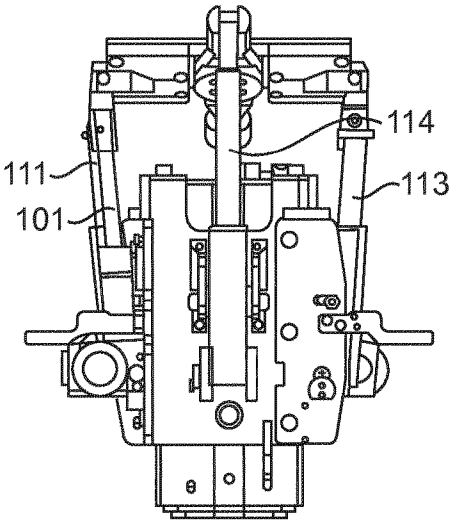
FIGS. 7B to 7D are a side view, an end view and a top plan view, respectively, of the components shown in FIG. 7A.
Figure 7C:
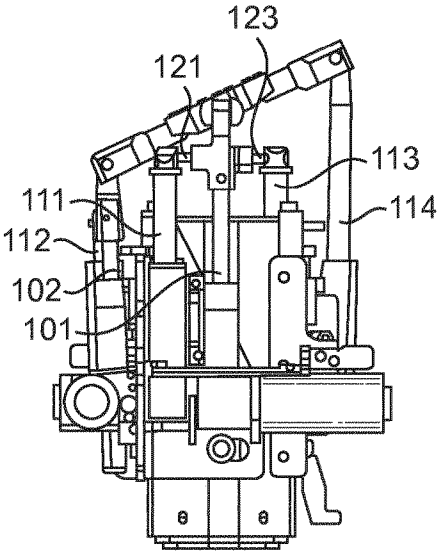
Figure 7D:
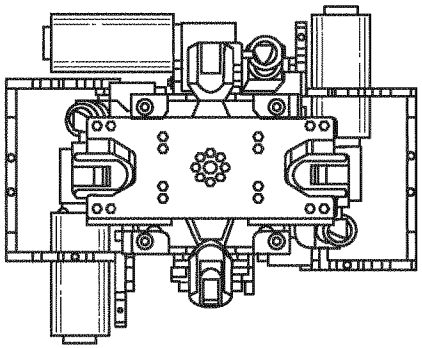
Figure 8A:
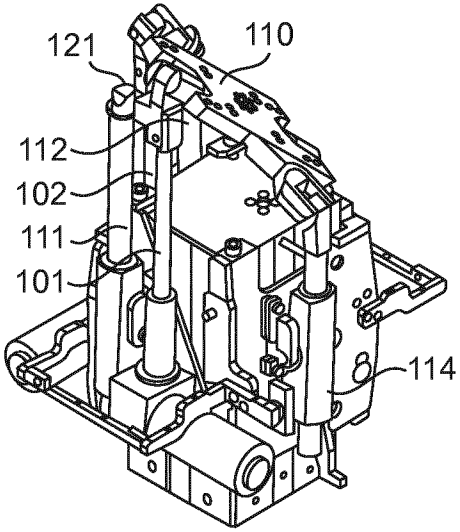
FIG. 8A is a perspective view of the column and the mechanism for coupling the tabletop to the column of the surgical table of FIG. 1, with the mechanism in a position for causing the tabletop to assume a compound position comprising maximum Trendelenburg and maximum left hand tilt.
Figure 8B:
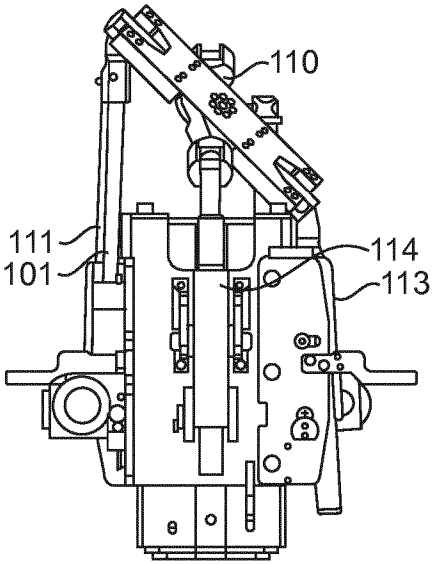
FIGS. 8B to 8D are a side view, an end view and a top plan view, respectively, of the components shown in FIG. 8A.
Figure 8C:
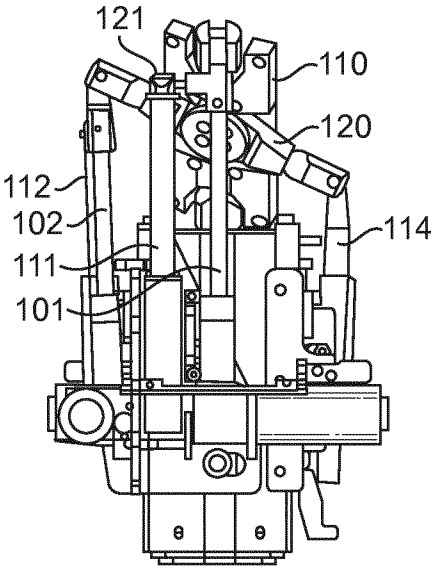
Figure 8D:
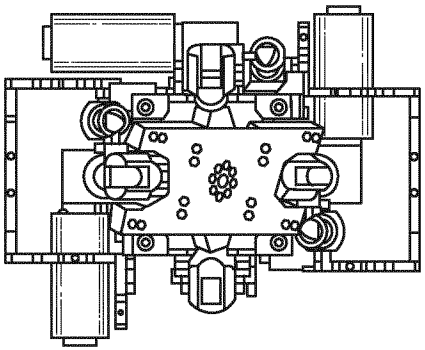
Figure 9A:
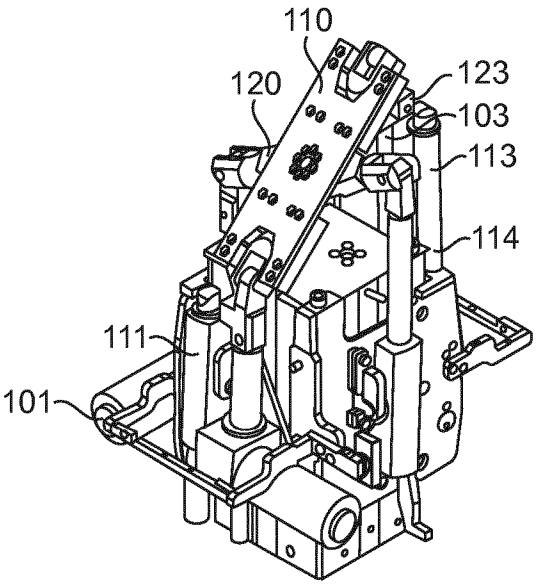
FIG. 9A is a perspective view of the column and the mechanism for coupling the tabletop to the column of the surgical table of FIG. 1, with the mechanism in a position for causing the tabletop to assume a compound position comprising maximum reverse-Trendelenburg and maximum right hand tilt.
Figure 9B:
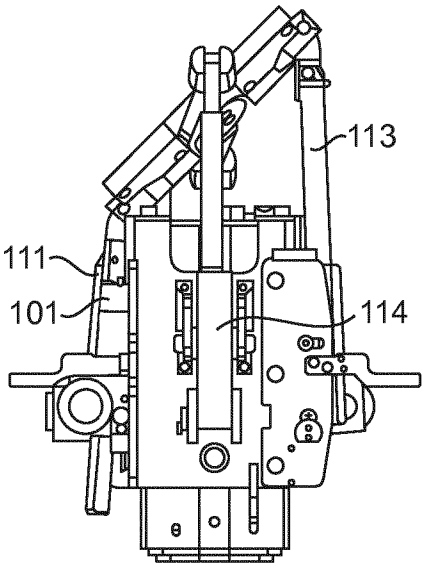
FIGS. 9B to 9D are a side view, an end view and a top plan view, respectively, of the components shown in FIG. 9A.
Figure 9C:
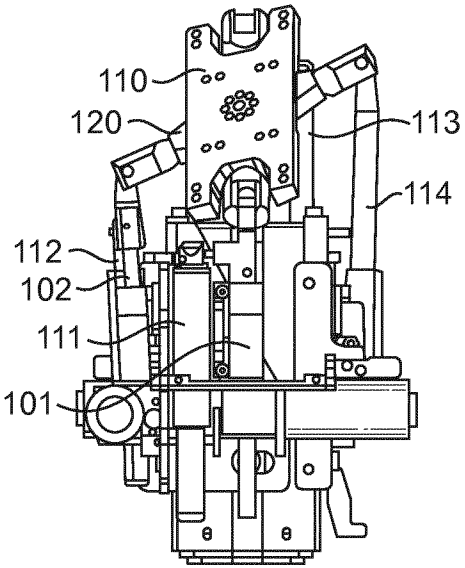
Figure 9D:
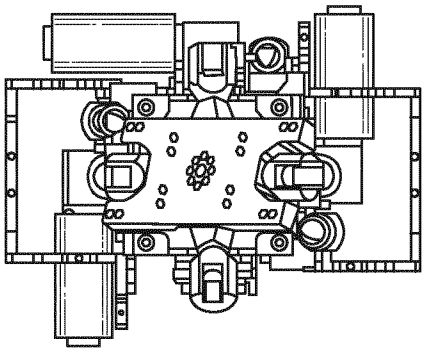
Figure 10A:
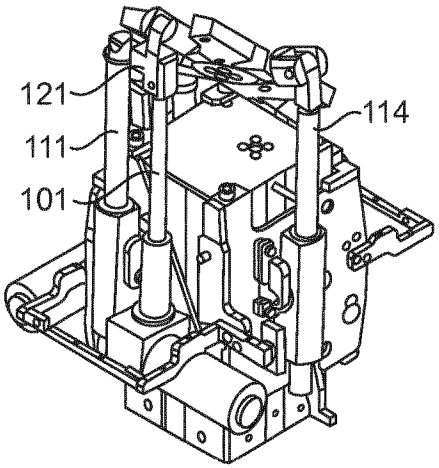
FIG. 10A is a perspective view of the column and the mechanism for coupling the tabletop to the column of the surgical table of FIG. 1, with the mechanism in a position for causing the tabletop to assume a compound position comprising maximum Trendelenburg and maximum right hand tilt.
Figure 10B:
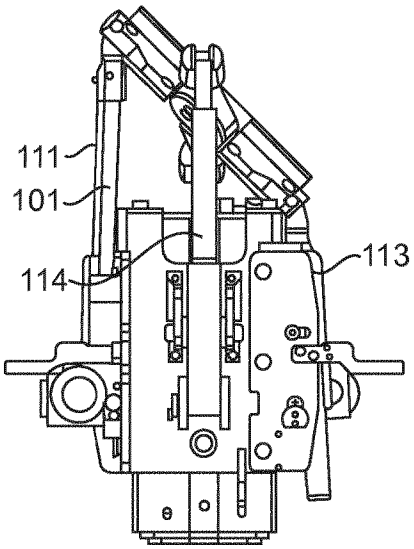
FIGS. 10B to 10D are a side view, an end view and a top plan view, respectively, of the components shown in FIG. 10A.
Figure 10C:
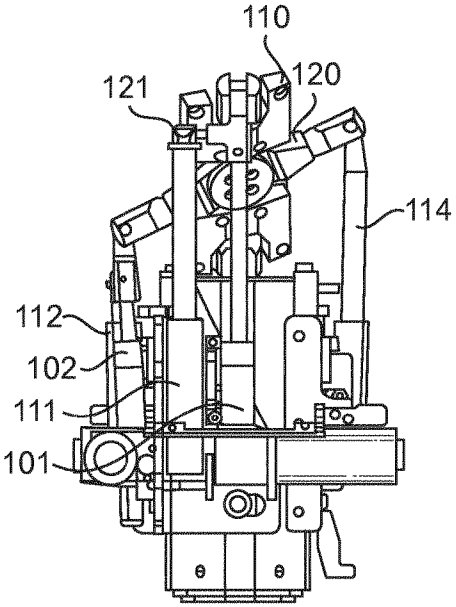
Figure 10D:
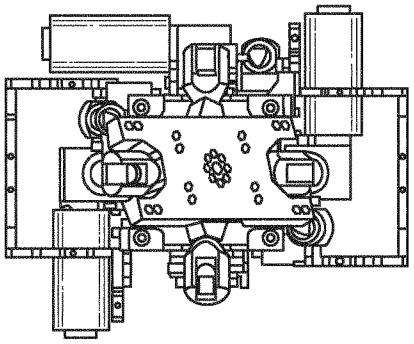
Figure 11A:
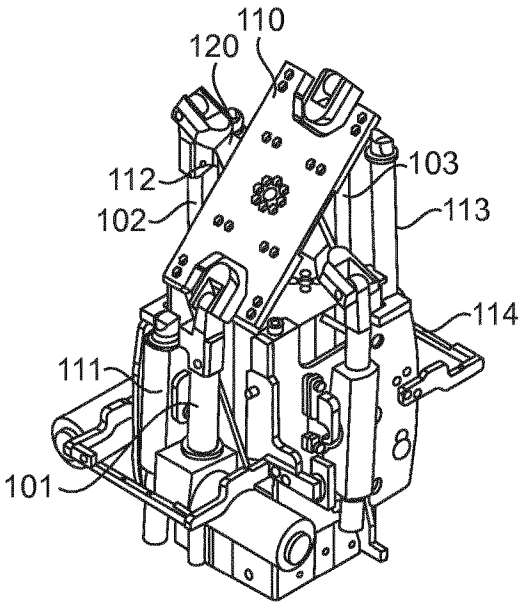
FIG. 11A is a perspective view of the column and the mechanism for coupling the tabletop to the column of the surgical table of FIG. 1, with the mechanism in a position for causing the tabletop to assume a compound position comprising maximum reverse-Trendelenburg and maximum left hand tilt.
Figure 11B:
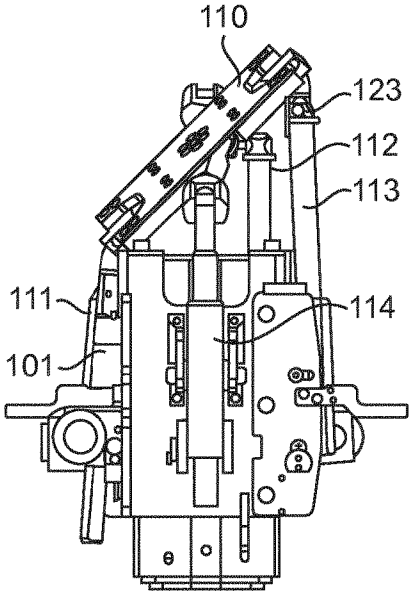
FIGS. 11B to 11D are a side view, an end view and a top plan view, respectively, of the components shown in FIG. 11A.
Figure 11C:
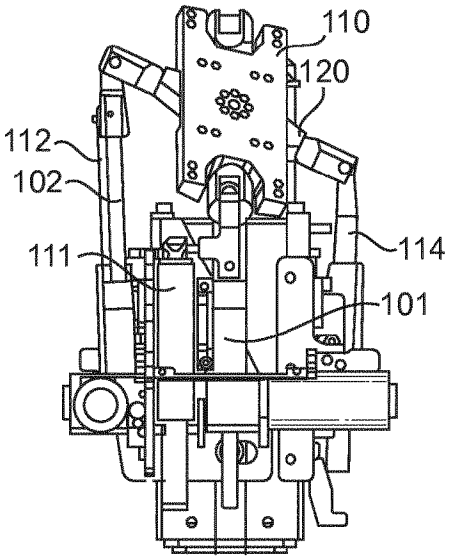
Figure 11D:
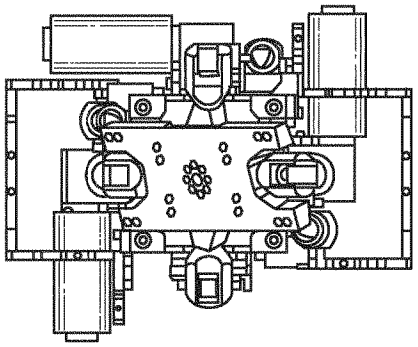

Referring to FIG. 1, a surgical table, designated generally as 2, includes a base 4, which stands on a floor 6, a column 8 of adjustable height extending from the base 4 and a tabletop 10 providing a patient support surface 12. In a variation to this embodiment, the column 8 is not of adjustable height. The base 4 may include wheels for moving the table 2 along the floor 6.

As depicted in FIG. 1, the tabletop 10 is divided into five sections, namely a head section 14, an upper torso section 16, a lower torso section 18 and a pair of laterally adjacent leg sections 20, 20, of which only one is shown in FIG. 1. Each of the sections of the tabletop 10 provides a portion of the patient support surface 12, and each of the sections has a respective separate mattress 22, 24, 26, 28, 28.

The lower torso section 18 is coupled to the column 8. A lower end 35 of the upper torso section 16 is detachably mounted on an upper end 41 of the lower torso section 18 by means of transversely adjacent first and second pivot joints 30, 32, which define a transverse axis about which the upper torso section 16 can be displaced relative to the lower torso section 18.

Each of the leg sections 20 is detachably mounted on a lower end 42 of the lower torso section 18 by a respective one of transversely adjacent third and fourth pivot joints 44, 46, of which only one is visible in FIG. 1, for displacement relative to the lower torso section 18 about a transverse axis defined by the respective one of third and fourth pivot joints 44, 46.

A lower end 34 of the head section 14 is detachably mounted on an upper end 36 of the upper torso section 16 by means of a fifth pivot joint 38 defining a transverse axis about which the head section 14 can be displaced relative to the upper torso section 16. The angle of inclination of the head section 14 is controlled manually by means of a pair of conventional adjustable struts 40, only one of which is shown in FIG. 1, secured to and extending between the underside of the head section 14 and the upper torso section 16, one on each side of the tabletop 10. The struts 40 may be hydraulic or electric actuators or lockable gas springs.

The provision of the five pivot joints 30, 32, 38, 44, 46 permits the five sections 14, 16, 18, 20, 20 selectively to be inclined relative to adjacent sections 14, 16, 18, 20, 20 thereby to dispose the tabletop 10 in a selected configuration. Moreover, that the head section 14 is detachable from the upper torso section 16, and each of the upper torso section 16 and the leg sections 20, 20 is detachable from the lower torso section 18 means that the table 2 may be made compact for storage.

As described in more detail below, the surgical table 2 also includes mechanisms for inclining the whole tabletop 10 relative to the column 8 and base 4 and relative to the horizontal about transverse and longitudinal axes of the tabletop 10. Inclination about the transverse axis of the tabletop 10 is referred to in the art as "trending", which is a shortening of the term "Trendelenburg", while inclination about the longitudinal axis of the tabletop 10 is referred to as "tilting". The trend and tilt movements can be controlled independently. Compound movements also are possible, in which the tabletop 10 is inclined about both the transverse and longitudinal axes of the tabletop 10 at the same time.

As used herein, the longitudinal axis of the tabletop is the major axis of the tabletop and the transverse axis of the tabletop is the orthogonal minor axis of the tabletop. The longitudinal direction of the tabletop is parallel to the major axis and the transverse direction of the tabletop is parallel to the minor axis. That is, the transverse direction of the tabletop is perpendicular to, or orthogonal to, the longitudinal direction of tabletop.

The surgical table 2 includes a mechanism for selectively increasing or decreasing the height of the column 8 (i.e. increasing or decreasing the distance between the base 4 and the tabletop 10), thereby to adjust the height of the tabletop 10 above the base 4 and floor 6.

FIGS. 2A to 2D show first, second and third parts 81, 82, 83 of the column 8, which are in the form of first, second and third nestable tubes that have respective longitudinal axes that are coincident with a vertical axis V-V of the table 2. The first, second and third parts 81, 82, 83 of the column 8 are disposed within the outer telescopic casing 48 of the column 8 shown in FIG. 1. The third tube 83 has a substantially square outer cross section and, although not shown in these Figures, has a bottom end that is fixed to the base 4. Accordingly, the column 8 extends upwardly from the base 4 in the direction of the vertical axis V-V of the table 2. The second tube 82 has substantially square inner and outer cross sections, the inner cross section of the second tube 82 being of slightly greater dimensions than the outer cross section of the third tube 83, to enable the third tube 83 to be slidably disposed within the second tube 82. Each of the second and third tubes 82, 83 has a guide that cooperates with a guide of the other of the second and third tubes 82, 83, to guide movement of the second tube 82 relative to the third tube 83 in the direction of the vertical axis V-V of the table 2. The first tube 81 has substantially square inner and outer cross sections, the inner cross section of the first tube 81 being of slightly greater dimensions than the outer cross section of the second tube 82, to enable the second tube 82 to be slidably disposed within the first tube 81. Each of the first and second tubes 81, 82 has a guide that cooperates with a guide of the other of the first and second tubes 81, 82, to guide movement of the first tube 81 relative to the second tube 82 in the direction of the vertical axis V-V of the table 2.

Figure 12:
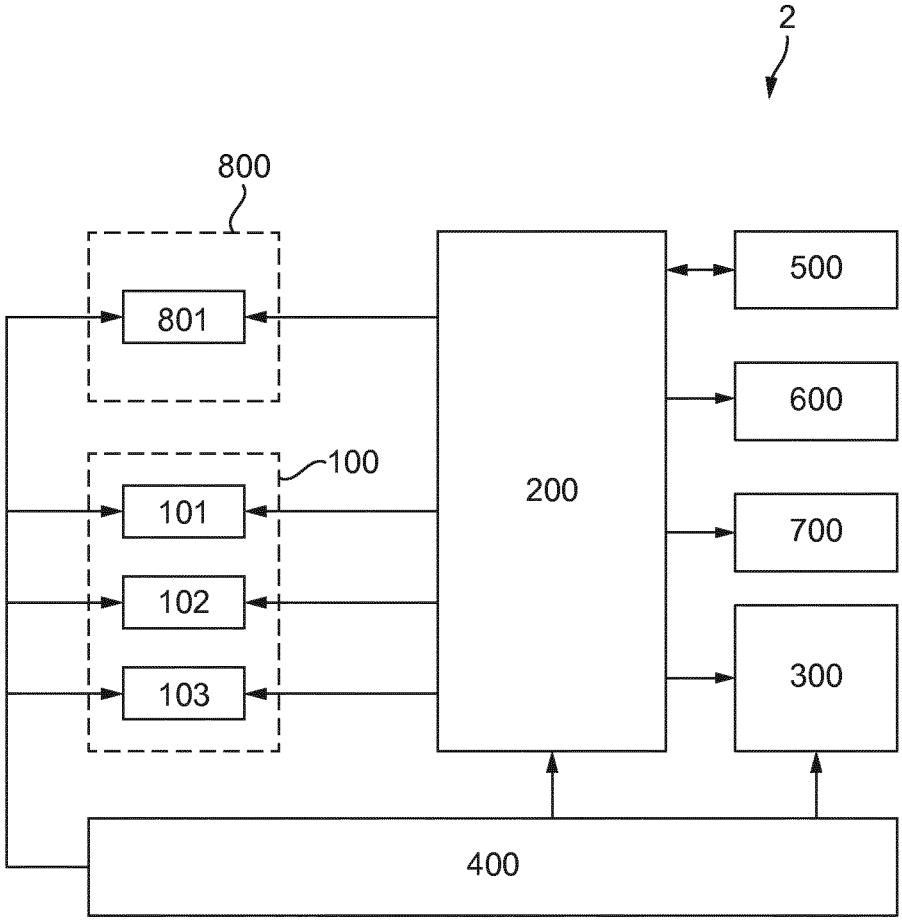
FIG. 12 is a schematic view of components of the surgical table of FIG. 1.

Within the third tube 83 is disposed a column height adjustment system 800 comprising an extendible column actuator 801 (see FIG. 12), such as an electric linear (e.g. screw) actuator. One part of the column actuator is fixed to the base 4 or the third tube 83, and another part of the column actuator is fixed to an upper part of the first tube 81. The two parts of the column actuator move relative to each other when the column actuator is extended. Accordingly, when the column actuator is operated so as to be extended, the first tube 81 is raised relative to the second and third tubes 82, 83 and relative to the base 4, thereby to increase the height of the column 8 and thereby to increase the height of the tabletop 10 above the base 4. As a lower end of the first tube 81 reaches an upper end of the second tube 82, cooperating features of the first and second tubes 81, 82 cause the second tube 82 to be lifted with the first tube 81 relative to the third tube 83 and relative to the base 4, thereby to further increase the height of the column 8 and thereby to further increase the height of the tabletop 10 above the base 4. As a lower end of the second tube 82 reaches an upper end of the third tube 83, cooperating features of the second and third tubes 82, 83 prevent further lifting of the first and second tubes 81, 82 by the column actuator and the column 8 has reached its maximum height.

In FIGS. 2A to 2D, the column 8 is shown at its minimum height, with the first, second and third tubes 81, 82, 83 nested together to the maximum possible extent. When the first tube 81 has been elevated to its maximum possible height relative to the base 4, the first, second and third tubes 81, 82, 83 are un-nested to the maximum possible extent, whereby the column 8 is then at its maximum height. Of course, in variations to this embodiment, the column 8 may have only two parts 81, 82 or more than three parts 81, 82, 83.

In accordance with one aspect of the present invention, a surgical table is provided with a mechanism for inclining a tabletop of the table over a wide range of angles about two orthogonal axes. In the present embodiment, the surgical table 2 is provided with a mechanism to enable the whole tabletop 10 to be inclined relative to the horizontal about a transverse axis across the table 2 and the whole tabletop 10 to be inclined relative to the horizontal about a longitudinal axis extending along the length of the tabletop 10. More particularly, the upper torso section 16 of the tabletop 10 is coupled to the column 8 by a mechanism 100 that is adapted to be movable, by operation of a drive mechanism, to enable the upper torso portion 16 and the rest of the tabletop 10 to be rotatably moved relative to the column 8 and relative to the horizontal about either or both of two orthogonal axes.

The mechanism 100 comprises a first frame or plate 110 which is connected to an underside of the upper torso section 16 of the tabletop 10 via a tabletop traverse mechanism (not shown) for enabling movement of the tabletop 10 relative to the column 8 and base 4 in a selected longitudinal direction of the tabletop 10. In a variation to this embodiment, the tabletop traverse mechanism is omitted. The mechanism 100 further comprises a second frame or plate 120 that is rotatably mounted on the first frame 110 about an axis A5-A5 that is orthogonal to both the longitudinal and transverse directions of the tabletop 10.

As used herein, the phrase "X rotatably mounted on Y about an axis Z" means X is mounted on Y and is rotatable relative to Y about axis Z.

The mechanism 100 further comprises first, second and third actuators 101, 102, 103. The first frame 110 is connected to the first part 81 of the column 8 via the first actuator 101 and via the third actuator 103 in parallel to the first actuator 101. In this context, "parallel" means parallel in the sense of physical topology, rather than geometrically parallel. No further actuators connect the first frame 110 to the column 8, so the total number of actuators via which the first frame 110 is connected to the column 8 is only two. The second frame 120 is connected to the first part 81 of the column 8 via the second actuator 102. No further actuators connect the second frame 120 to the column 8, so the total number of actuators via which the second frame 120 is connected to the column 8 is only one.

The first and third actuators 101, 103 are for moving the first frame 110 relative to the column 8 about the transverse axis of the tabletop 10, which is parallel to the transverse direction of the tabletop 10. The second actuator 102 is for moving the second frame 120 relative to the column 8 about the longitudinal axis of the tabletop 10, which is parallel to the longitudinal direction of the tabletop 10. Due to the second frame 120 being mounted on the first frame 100, each of the first, second and third actuators 101, 102, 103 actually is for moving both the first and second frames 110, 120 relative to the column 8 about one or other of the transverse and longitudinal axes of the tabletop 10.

The first frame 110 is connected to the first and third actuators 101.103 by a first gimbal mechanism 50 and the second frame 120 is connected to the second actuator 102 by a second gimbal mechanism 60. The first gimbal mechanism 50 is configured to rotate the tabletop 10 about an axis parallel to the transverse direction of the tabletop (i.e. in a Trendelenburg or reverse Trendelenburg movement) and the second gimbal mechanism 60 is configured to rotate the tabletop 10 about an axis parallel to the longitudinal direction of the tabletop 10 (i.e. in a tilt movement in either a left or right direction relative to the longitudinal direction of the tabletop 10).

The first actuator 101 comprises a cylinder 101*a* rotatably connected to a first side of the column 8 about only a single first axis A1-A1, and an elongate part 101*b* movably disposed within the cylinder 101*a* and connected to a first end portion of the first frame 110 via a first universal joint 101*c*. The third actuator 103 comprises a cylinder 103*a* rotatably connected to a third side of the column 8 about only a single third axis A3-A3 spaced from and parallel to the first axis A1-A1, and an elongate part 103*b* movably disposed within the cylinder 103*a* and connected to a second end portion of the first frame 110 via a third universal joint 103*c*. The third side of the column 8 is opposed to the first side of the column 8, and the first and second end portions of the first frame 110 are opposite end portions of the first frame 110.

Similarly, the second actuator 102 comprises a cylinder 102*a* rotatably connected to a second side of the column 8 about only a second axis A2-A2 that is orthogonal to the first and third axes A1-A1, A3-A3, and an elongate part 102*b* movably disposed within the cylinder 102*a* and connected to a first end portion of the second frame 120 via a second universal joint 102*c*. The first and third axes A1-A1, A3-A3 are parallel to the transverse direction of the tabletop 10 and the second axis A2-A2 is parallel to the longitudinal direction of the tabletop 10. Each of the actuators 101, 102, 103 preferably comprises an electric motor for moving the elongate part of the actuator relative to the cylinder of the actuator.

The mechanism 100 further comprises first, second, third and fourth extensible stabilisers 111, 112, 113, 114. The first frame 110 is connected to the first part 81 of the column 8 via the first and third extensible stabilisers 111, 113 in parallel with the first and third actuators 101, 103, and the second frame 120 is connected to the first part 81 of the column 8 via the second and fourth extensible stabilisers 112, 114 in parallel with the second actuator 102. In this context, "parallel" means parallel in the sense of physical topology, rather than geometrically parallel. The total number of extensible stabilisers via which the first frame 110 is connected to the column 8 is only two, and the total number of extensible stabilisers via which the second frame 120 is connected to the column 8 is only two. It is to be noted that all of the first to third actuators 101 to 103 are disposed outside all of the first to fourth extensible stabilisers 111 to 114.

The first extensible stabiliser 111 comprises a cylinder 111*a* rotatably connected to the first side of the column 8 about only a single axis spaced from and parallel to the first axis A1-A1, and an elongate part 111*b* movably disposed within the cylinder 111*a* and connected to the first end portion of the first frame 110 via the first universal joint 101*c*. In particular, the elongate part 111*b* of the first extensible stabiliser 111 is connected to the elongate part 101*b* of the first actuator 101 via a first rotatable joint 121, which first rotatable joint 121 permits relative rotation of the elongate part 111*b* of the first extensible stabiliser 111 and the elongate part 101*b* of the first actuator 101. The third extensible stabiliser 113 comprises a cylinder 113*a* rotatably connected to the third side of the column 8 about only a single axis spaced from and parallel to the third axis A3-A3, and an elongate part 113*b* movably disposed within the cylinder 113*a* and connected to the second end portion of the first frame 110 via the third universal joint 101*c*. In particular, the elongate part 113*b* of the third extensible stabiliser 113 is connected to the elongate part 103*b* of the third actuator 103 via a third rotatable joint 123, which third rotatable joint 123 permits relative rotation of the elongate part 113*b* of the third extensible stabiliser 113 and the elongate part 103*b* of the third actuator 103.

Similarly, the second extensible stabiliser 112 comprises a cylinder 112*a* rotatably connected to the second side of the column 8 about only a single axis spaced from and parallel to the second axis A2-A2, and an elongate part 112*b* movably disposed within the cylinder 112*a* and connected to the first end portion of the second frame 120 via the second universal joint 102*c*. In particular, the elongate part 112*b* of the second extensible stabiliser 112 is connected to the elongate part 102*b* of the second actuator 102 via a second rotatable joint 122, which second rotatable joint 122 permits relative rotation of the elongate part 112*b* of the second extensible stabiliser 112 and the elongate part 102*b* of the second actuator 102. The fourth extensible stabiliser 114 comprises a cylinder 114*a* rotatably connected to a fourth side of the column 8 about only a single fourth axis A4-A4 spaced from and parallel to the second axis A2-A2, and an elongate part 114*b* movably disposed within the cylinder 114*a* and connected to a second end portion of the second frame 120 via a fourth universal joint 104*c*. The fourth side of the column 8 is opposed to the second side of the column 8, and the first and second end portions of the second frame 120 are opposite end portions of the second frame 120.

In variations to this embodiment, the first extensible stabiliser 111 is rotatably connected to the column 8 about only the first axis A1-A1, and/or the second extensible stabiliser 112 is rotatably connected to the column 8 about only the second axis A2-A2, and/or the third extensible stabiliser 113 is rotatably connected to the column 8 about only the third axis A3-A3, and/or the fourth extensible stabiliser 114 is rotatably connected to the column 8 about only a single axis spaced from and parallel to the fourth axis A4-A4.

In FIGS. 2A to 2D, all of the first, second and third actuators 101, 102, 103 are fully contracted, i.e. extended to a minimum extent. Likewise, all of the first, second, third and fourth extensible stabilisers 111, 112, 113, 114 are fully contracted, i.e. extended to a minimum extent. In such a state, the mechanism 100 is at its minimum height. In comparison, in FIGS. 3A to 3D, all of the first, second and third actuators 101, 102, 103 have been extended to their maximum extents, which in turn causes extension of the first, second, third and fourth extensible stabilisers 111, 112, 113, 114. In such a state, the mechanism 100 is at its maximum height. Accordingly, it will be appreciated that extension of all of the first, second and third actuators 101, 102, 103 increases the height of the mechanism 100 (i.e. increases the distance between the column 8 and the tabletop 10), thereby increasing the height of the tabletop 10 above the column 8 and above the base 4.

Selectively extending or contracting the first to third actuators 101, 102, 103 causes the tabletop 10 to become inclined relative to the column 8 and relative to the horizontal about the transverse and/or longitudinal axes of the tabletop 10.

For example, in FIGS. 4A to 4D, the first actuator 101 and first extensible stabiliser 111 are fully extended, the third actuator 103 and third extensible stabiliser 113 are fully contracted, and the second actuator 102 and the second and fourth extensible stabiliser 112, 114 are partially extended. This causes the tabletop 10 to be inclined relative to the column 8 and base 4 and relative to the horizontal at a positive angle of 45 degrees about the transverse axis of the tabletop 10 at a maximum Trendelenburg position. Contrastingly, in FIGS. 5A to 5D, the first actuator 101 and first extensible stabiliser 111 are fully contracted, the third actuator 103 and third extensible stabiliser 113 are fully extended, and the second actuator 102 and the second and fourth extensible stabilisers 112, 114 remain partially extended. This causes the tabletop 10 to be inclined relative to the column 8 and base 4 and relative to the horizontal at a negative angle of 45 degrees about the transverse axis of the tabletop 10 at a minimum Trendelenburg position, i.e. at a maximum reverse-Trendelenburg position.

In FIGS. 6A to 6D, the second actuator 102 and second extensible stabiliser 112 are nearly fully extended, the fourth extensible stabiliser 114 is nearly fully contracted, and the first and third actuators 101, 103 and the first and third extensible stabilisers 111, 113 are partially extended. This causes the tabletop 10 to be inclined relative to the column 8 and base 4 and relative to the horizontal at a positive angle of 25 degrees about the longitudinal axis of the tabletop 10 at a maximum left hand tilt. Contrastingly, in FIGS. 7A to 7D, the second actuator 102 and second extensible stabiliser 112 are nearly fully contracted, the fourth extensible stabiliser 114 is nearly fully extended, and the first and third actuators 101, 103 and the first and third extensible stabilisers 111, 113 remain partially extended. This causes the tabletop 10 to be inclined relative to the column 8 and base 4 and relative to the horizontal at a negative angle of 25 degrees about the longitudinal axis of the tabletop 10 at a maximum right hand tilt.

It is possible also to incline the tabletop 10 about both the transverse and longitudinal axes of the tabletop 10 simultaneously. Doing so causes relative rotation of the first and second frames 110, 120 about the axis A5-A5 orthogonal to both the longitudinal and transverse directions of the tabletop 10 as shown in each of FIGS. 8A to 11D, as compared to their relative position when the first, second and third actuators 101, 102, 103 are all extended or contracted to the same degree, as shown in each of FIGS. 2A to 7D.

As shown in FIGS. 8A to 8D, the first actuator 101 and the first extensible stabiliser are fully extended, the second actuator 102 and the second extensible stabiliser 112 are nearly fully extended, the third actuator 103 and the third extensible stabiliser 113 are fully contracted, and the fourth extensible stabiliser 114 is nearly fully contracted. This causes the tabletop 10 to be inclined relative to the column 8 and base 4 and relative to the horizontal at positive angles about both the transverse and longitudinal axes of the tabletop 10. As shown in FIGS. 9A to 9D, the first actuator 101 and the first extensible stabiliser are fully contracted, the second actuator 102 and the second extensible stabiliser 112 are nearly fully contracted, the third actuator 103 and the third extensible stabiliser 113 are fully extended, and the fourth extensible stabiliser 114 is nearly fully extended. This causes the tabletop 10 to be inclined relative to the column 8 and base 4 and relative to the horizontal at negative angles about both the transverse and longitudinal axes of the tabletop 10. As shown in FIGS. 10A to 10D, the first actuator 101 and the first extensible stabiliser are nearly fully extended, the second actuator 102 and the second extensible stabiliser 112 are fully extended, the third actuator 103 and the third extensible stabiliser 113 are fully contracted, and the fourth extensible stabiliser 114 is nearly fully extended. This causes the tabletop 10 to be inclined relative to the column 8 and base 4 and relative to the horizontal at a positive angle about the transverse axis of the tabletop 10 and at a negative angle about the longitudinal axis of the tabletop 10. As shown in FIGS. 11A to 11D, the first actuator 101 and the first extensible stabiliser are fully contracted, the second actuator 102 and the second extensible stabiliser 112 are nearly fully extended, the third actuator 103 and the third extensible stabiliser 113 are fully extended, and the fourth extensible stabiliser 114 is nearly fully contracted. This causes the tabletop 10 to be inclined relative to the column 8 and base 4 and relative to the horizontal at a negative angle about the transverse axis of the tabletop 10 and at a positive angle about the longitudinal axis of the tabletop 10.

Naturally, the degree of extension of each of the three actuators 101, 102, 103 can be selected to position the tabletop 10 at a desired degree and direction of inclination relative to the column 8 and base 4 and relative to the horizontal, or to position the tabletop 10 parallel to the horizontal.

Since a distance between the first and second plates 110, 120 and the column 8 is increasable by extending all of the first, second and third actuators 101, 102, 103 (and all of the first, second, third and fourth extensible stabilisers 111, 112, 113, 114), it is possible to incline the tabletop 10 relative to the column 8 over a greater range of angles, as compared to a comparable table in which it is not possible to increase a distance between the first and second plates 110, 120 and the column 8. Accordingly, the table 2 is provided with increased versatility as compared to the comparable table.

Moreover, since in the illustrated embodiment the first, second, third and fourth extensible stabilisers 111, 112, 113, 114 are provided in parallel to the first, second and third actuators 101, 102, 103, the extensible stabilisers 111, 112, 113, 114 are able to help withstand lateral loading of the table 2. Accordingly, the first, second and third actuators 101, 102, 103 can be made less robust (laterally, at least) than the actuators of a comparable table in which the extensible stabilisers are omitted.

The provision of the extensible stabilisers 111, 112, 113, 114 minimises lateral loading acting on the actuators 101, 102, 103, by resisting unwanted rotational movement of the assembly of the first and second frames 110, 120. Lateral loading is significant in operating tables as a result of typically high offset loads and twisting torques that can be applied to the tabletop 10. The extensible stabilisers 111, 112, 113, 114 effectively act as an exoskeleton that ensures that actuator loading is only compressive and substantially in line with the longitudinal axes of the actuators 101, 102, 103. The provision of the extensible stabilisers 111, 112, 113, 114 is highly desired, because the assembly of the tabletop 10 and the first and second frames 110, 120 is not connected directly to the column 8 as per some conventional operating tables. In the table 2 of the present embodiment, the trend and tilt rotation axes are effectively floating above the column 8. Moreover, in embodiments in which each of the actuators 101, 102, 103 comprises a ball screw and a ball screw nut connection to a gearbox, there is inherent lateral movement or free play within each of the actuators 101, 102, 103 that could contribute to unwanted tabletop 10 movement, since this effect is magnified at the tabletop 10. The provision of the extensible stabilisers 111, 112, 113, 114 reduces or eliminates this free play or unwanted movement of the tabletop 10.

However, in a variation to the illustrated embodiment, the first, second, third and fourth extensible stabilisers 111, 112, 113, 114 may be omitted and the first, second and third actuators 101, 102, 103 made more robust (laterally, at least). In another variation to the illustrated embodiment, only the first, second and third extensible stabilisers 111, 112, 113 may be omitted and the first, second and third actuators 101, 102, 103 made more robust (laterally, at least). In the illustrated embodiment, and even in such variations to the illustrated embodiment, the first and third actuators 101, 103 arranged in a first plane counteract lateral loads against the second actuator 102 and the fourth extensible stabiliser 114 arranged in a second plane orthogonal to the first plane. Similarly, the second actuator 102 and the fourth extensible stabiliser 114 arranged in the second plane counteract lateral loads against the first and third actuators 101, 103 arranged in the first plane.

In the illustrated embodiment, there are provided four extensible stabilisers 111, 112, 113, 114 but only three actuators 101, 102, 103, since it has been found that the table 2 is robust enough to perform the required tilting movements of the tabletop 10 using only the single second actuator 102. Accordingly, the table 2 is cheaper to manufacture, more reliable and less complex to control than a comparable table with four actuators. However, in a variation to the illustrated embodiment, a fourth actuator may be provided, comprising a cylinder rotatably connected to the fourth side of the column 8 about only the single fourth axis A4-A4 or an axis spaced from and parallel to the fourth axis A4-A4, and an elongate part movably disposed within the cylinder and connected to the second end portion of the second frame 120 via the fourth universal joint 104*c*. The elongate part 114*b* of the fourth extensible stabiliser 114 may be connected to the elongate part of the fourth actuator via a fourth rotatable joint (not shown), which fourth rotatable joint would permit relative rotation of the elongate part 114*b* of the fourth extensible stabiliser 114 and the elongate part of the fourth actuator. Such a fourth actuator would be disposed outside all of the first to fourth extensible stabilisers 111 to 114.

In accordance with another aspect of the invention, a surgical table is provided with an alternative mechanism for adjusting a height of a tabletop thereof.

In this embodiment, the column height adjustment system 800 comprises the column actuator 801, and a mechanism height adjustment system comprises the first, second and third actuators 101, 102, 103 of the mechanism 100.

As discussed above, extension of the column actuator 801 increases the height of the column 8 until the column 8 reaches its maximum height (not shown) when the first, second and third tubes 81, 82, 83 are un-nested to the maximum possible extent. This maximum height of the column 8 will be referred to for the present discussion as a first maximum height. Conversely, contraction of the column actuator 801 decreases the height of the column 8 until the column 8 reaches its minimum height (see FIGS. 2A to 2D) when the first, second and third tubes 81, 82, 83 are nested together to the maximum possible extent. This minimum height of the column 8 will be referred to for the present discussion as a first minimum height. A difference between the first minimum height and the first maximum height, i.e. the total height or length by which the column 8 is extendible, is referred to as a first range.

As also discussed above, extension of all of the first, second and third actuators 101, 102, 103 increases the height of the mechanism 100 until the mechanism 100 reaches its maximum height (see FIGS. 3A to 3D), which will be referred to for the present discussion as a second maximum height. Conversely, contraction of all of the first, second and third actuators 101, 102, 103 decreases the height of the mechanism 100 until the mechanism 100 reaches its minimum height (see FIGS. 2A to 2D), which will be referred to for the present discussion as a second minimum height. A difference between the second minimum height and the second maximum height, i.e. the total height or length by which the mechanism 100 is extendible, is referred to as a second range.

In the present embodiment, the total height or length by which the column 8 is extendible is greater than the total height or length by which the mechanism 100 is extendible. That is, the first range is greater than the second range. Specifically, in the present embodiment, the total height or length by which the column 8 is extendible is approximately 480 millimetres, while the total height or length by which the mechanism 100 is extendible is approximately 200 millimetres. Accordingly, a ratio of the first range to the second range is approximately 2.4:1 (2.4 to 1).

Of course, in variations to this embodiment the values of the first and second ranges may vary. For example, preferably the first range is between 400 and 600 millimetres, and preferably the second range is between 100 and 300 millimetres. Regardless as to the specific values of the first and second ranges, preferably a ratio of the first range to the second range is between 1.25:1 and 4:1, and more preferably the ratio is between 2:1 and 3:1.

Moreover, in the present embodiment a controller 200 (see FIG. 12) of the table 2 is communicatively connected to the column actuator 801 of the column height adjustment system 800 and communicatively connected to the first, second and third actuators 101, 102, 103 of the mechanism height adjustment system. The controller 200 is configured to control the column height adjustment system 800 and the mechanism height adjustment system, for example to adjust the overall height of the tabletop 10 above the base 4 and floor 6, in dependence on one or more instructions received at the controller 200 from a user interface 300 (see FIG. 12) of the table 2. The user interface 300 may be attached to the table 2 or may be provided in a portable handset communicatively connected to components of the table 2.

The controller 200 is configured to control the mechanism height adjustment system to adjust the height of the mechanism 100, and thereby to adjust the overall height of the tabletop 10 above the base 4 and floor 6, only when the height of the column 8 is one of the first minimum height and the first maximum height. Thus, when the overall height of the tabletop 10 is some way between the minimum and maximum overall heights, and when the column 8 is not at either of the first minimum and first maximum heights, on receipt at the controller 200 from the user interface 300 of an instruction to increase or decrease the overall height of the tabletop 10, the controller 200 is configured to first control the column actuator 801 of the column height adjustment system 800 to increase or decrease, respectively, the height of the column 8. If the controller 200 continues to receive from the user interface 300 an instruction to increase or decrease, respectively, the overall height of the tabletop 10 when the column 8 reaches the first maximum height or the first minimum height, respectively, the controller 200 is configured then to control the first, second and third actuators 101, 102, 103, as required, of the mechanism height adjustment system to increase or decrease, respectively, the height of the mechanism 100.

Looked at another way, when the overall height of the tabletop 10 is at the maximum overall height or the minimum overall height, on receipt at the controller 200 from the user interface 300 of an instruction to decrease or increase, respectively, the overall height of the tabletop 10, the controller 200 is configured first to control the first, second and third actuators 101, 102, 103, as required, of the mechanism height adjustment system to decrease or increase, respectively, the height of the mechanism 100 to a height (preferably a mid-point) between the second minimum and maximum heights. If the controller 200 continues to receive from the user interface 300 an instruction to decrease or increase, respectively, the overall height of the tabletop 10 when the mechanism 100 reaches the height between the second minimum and maximum heights, the controller 200 is configured then to control the column actuator 801 of the column height adjustment system 800 to decrease or increase, respectively, the height of the column 8, while maintaining the height of the mechanism 100 at the height between the second minimum and maximum heights. If the controller 200 continues to receive from the user interface 300 an instruction to decrease or increase, respectively, the overall height of the tabletop 10 when the column 8 reaches the first minimum height or the first maximum height, respectively, the controller 200 is configured then to again control the first, second and third actuators 101, 102, 103, as required, of the mechanism height adjustment system to decrease or increase, respectively, the height of the mechanism 100 further towards the second minimum height or the second maximum height, respectively.

Accordingly, when adjusting the overall height of the tabletop 10 above the base 4 and floor 6 between the minimum overall height of the tabletop 10 (when the column 8 is at the first minimum height and the mechanism 100 is at the second minimum height) and the maximum overall height of the tabletop 10 (when the column 8 is at the first maximum height and the mechanism 100 is at the second maximum height), a majority of the change in height of the tabletop 10 above the base 4 and floor 6 is effected through operation of the column actuator 801 of the column height adjustment system 800. As such, the column actuator 801 can be made much more robust than the first, second and third actuators 101, 102, 103 of the mechanism height adjustment system, which permits the first, second and third actuators 101, 102, 103 to be small. Reducing the size of the first, second and third actuators 101, 102, 103 lowers a centre of mass of the table 2, which in turn increases stability of the table 2, and frees up space between the tabletop 10 and the column 8, which facilitates access to the top of the column 8 and underside of the tabletop 10 for maintenance.

Moreover, as discussed above, the first, second and third actuators 101, 102, 103 are used to adjust the tilt and trend of the tabletop 10. A greater degree of tilt and/or trend of the tabletop 10 is possible when the first, second and third actuators 101, 102, 103 are not fully extended or fully contracted. As also discussed above, when adjusting the overall height of the tabletop 10, the height of the mechanism 100 is first adjusted to a height (preferably a mid-point) between the second minimum and maximum heights, before the height of the column 8 is adjusted. Accordingly, a high degree of tilt and/or trend of the tabletop 10 is possible over a greater range of the overall height of the tabletop 10, as compared to a comparable table in which the height of the mechanism 100 is adjusted to one of the second minimum and maximum heights before the height of the column 8 is adjusted, when adjusting the overall height of the tabletop 10.

In variations to the illustrated embodiment, the table 2 comprises a lock mechanism for selectively fixing a height of the mechanism 100 at one of the second minimum height, the second maximum height, and a height between the second minimum height and the second maximum height. In such a variation, any adjustment in the overall height of the tabletop 10 is effected only through adjustment of the height of the column 8 when the height of the mechanism 100 is fixed through actuation of the lock mechanism. In effect, when actuated, such a lock mechanism acts to prevents the controller 200 from controlling the first, second and third actuators 101, 102, 103, as required, to adjust the height of the mechanism 100 and the overall height of the tabletop 10, while still permitting the controller 200 to adjust of the height of the first, second and third actuators 101, 102, 103, as required, to effect tilting and/or trending of the tabletop 10, and still permitting the controller 200 to control the column actuator 801 of the column height adjustment system 800 to decrease or increase, respectively, the height of the column 8, thereby to adjust the overall height of the tabletop 10. When the lock mechanism is for selectively fixing the height of the mechanism 100 at the second minimum height, the table 2 is more stable. When the lock mechanism is for selectively fixing the height of the mechanism 100 at the height between the second minimum height and the second maximum height, then it is better ensured that a great degree of tilt and/or trend of the tabletop 10 is possible through subsequent actuation of the first, second and third actuators 101, 102, 103, as required.

In some embodiments of the present invention, each of the first, second and third extensible stabilisers 111, 112, 113 may comprise a respective sensor, and the controller 200 may be configured to control the first, second and third actuators 101, 102, 103, respectively, to adjust a length of the first, second and third actuators 101, 102, 103, respectively, on the basis of an output of the respective sensors. For example, with reference to the first actuator 101 and the first extensible stabiliser 111, one of the cylinder 111*a* and the elongate part 111*b* of the first extensible stabiliser 111 may comprise a magnet, and the other of the cylinder 111*a* and the elongate part 111*b* of the first extensible stabiliser 111 may comprise a sensor, e.g. a hall effect sensor or a reed switch, configured to detect a magnetic field of the magnet. The controller 200 may be configured to control the first actuator 101 to adjust a length of the first actuator 101 on the basis of the output of the sensor, e.g. so as to avoid the elongate part 101*b* of the first actuator 101 being driven so far into the cylinder 101*a* of the first actuator 101 that the first rotatable joint 121 is brought into contact with the cylinder 101*a* of the first actuator 101, which could otherwise damage the cylinder 101*a* of the first actuator 101, the first rotatable joint 121, or the electric motor of the first actuator 101. Providing the sensors in the extensible stabilisers rather than in the actuators avoids having to modify, and possibly weaken, the actuators.

In accordance with another aspect of the invention, a surgical table is provided with one or more assistance mechanisms for helping medical staff using the surgical table to dispose a tabletop and a base of the surgical table at a predetermined relative position. Such a predetermined relative position may be, for example, the position at which a patient is most easily transferrable onto or from the table, or the position at which the tabletop and the base are best placed to enable a certain procedure to be performed on a patient supported by the table.

As discussed above, in the present embodiment a height of the tabletop 10 is adjustable in a vertical direction relative to the base 4, and the tabletop 10 also is traversable relative to the base 4 in the longitudinal direction of the tabletop 10, i.e. in the direction of the longitudinal axis of the tabletop 10. The table 2 of the present embodiment includes assistance mechanisms for helping medical staff using the table 2 to dispose the tabletop 10 and the base 4 at respective predetermined relative positions, such as predetermined default or home positions.

There now follows a description of the construction and operation of such an assistance mechanism for helping medical staff using the table 2 to dispose the tabletop 10 at a predetermined overall height relative to the base 4, i.e. at a position someway, e.g. midway, between the maximum and minimum overall heights relative to the base 4. For the purposes of this discussion, the column actuator 801 and/or the first, second and third actuators 101, 102, 103 are considered as comprised in the tabletop drive mechanism, and the controller 200 controls the tabletop drive mechanism to cause the translational movement of the tabletop 10 towards or away from the base 4 in the direction of the vertical axis V-V of the table 2.

In dependence on movement instruction(s) received at the controller 200 from the user interface 300, the controller 200 is configured to control the tabletop drive mechanism (or more specifically the column actuator 801 and/or the first, second and third actuators 101, 102, 103, as required) to cause translational movement of the tabletop 10 relative to the base 4 in the direction of the vertical axis V-V of the table 2 between the maximum and minimum overall heights via the predetermined overall height.

When the tabletop 10 is at the predetermined overall height relative to the base 4, the controller 200 controls the tabletop drive mechanism to cause the translational movement of the tabletop 10 relative to the base 4 in the direction of the vertical axis V-V of the table 2 to be paused for a predetermined period of time. In this embodiment, the predetermined period of time is 2 seconds. However, in variations to this embodiment, the predetermined period of time may be any time between 0.05 and 5 seconds, more preferably between 0.1 and 3 seconds, more preferably between 0.25 and 2 seconds, and most preferably between 1 and 2 seconds. The controller 200 is configured such that, if after elapse of the predetermined period of time the controller 200 still is receiving from the user interface 300 the movement instruction(s) to control the tabletop drive mechanism to cause the translational movement of the tabletop 10 relative to the base 4 in the direction of the vertical axis V-V of the table 2, then the controller 200 controls the tabletop drive mechanism to cause the translational movement of the tabletop 10 relative to the base 4 in the direction of the vertical axis V-V of the table 2 to be resumed. The controller 200 also is configured such that, if after elapse of the predetermined period of time the controller 200 no longer is receiving from the user interface 300 the movement instruction(s) to control the tabletop drive mechanism to cause the translational movement of the tabletop 10 relative to the base 4 in the direction of the vertical axis V-V of the table 2, then the controller 200 controls the tabletop drive mechanism to cause the translational movement of the tabletop 10 relative to the base 4 in the direction of the vertical axis V-V of the table 2 not to be resumed.

In this embodiment, the table 2 includes a sensor (not shown) communicatively connected to the controller 200 for sensing, and for notifying the controller 200, when the tabletop 10 is at the predetermined overall height relative to the base 4. The sensor could comprise a micro switch suitably connected to the one of the parts 81, 82, 83 of the column 8 so that a portion of another of the parts 81, 82, 83 of the column 8 is configured to actuate the micro switch when the tabletop 10 is at the predetermined overall height relative to the base 4. In variations to this embodiment, the sensor could take forms other than a micro switch and/or could comprise components located at different places on the table 2.

In variations to this embodiment, the controller 200 may determine when the tabletop 10 is at the predetermined overall height relative to the base 4 by a mechanism other than such a sensor. For example, the controller 200 may make the determination based on time elapsed since the tabletop 10 began moving from one or other of the maximum and minimum overall heights at a known speed, or (in embodiments in which respective first parts of the first, second, third and column actuators 101, 102, 103, 108 rotate relative to respective second parts of the first, second, third, and column actuators 101, 102, 103, 108 during extension or contraction of the first, second, third and column actuators 101, 102, 103, 108) based on the number of detected rotations of the first part of one of the first, second, third or column actuators 101, 102, 103, 108 relative to the second part of the one of the first, second, third or column actuators 101, 102, 103, 108 since the tabletop 10 began moving from one or other of the maximum and minimum overall heights.

It will thus be appreciated that, through the provision of the above-described assistance mechanism, users of the surgical table are alerted as to when the tabletop is at the predetermined overall height relative to the base, and are given the predetermined period of time in which to cause the user interface to stop sending the movement instruction(s) to the controller. Thus, there is provided a mechanism for helping users of the surgical table to dispose the tabletop of the surgical table at the predetermined overall height relative to the base.

It will be appreciated that the construction and operation of another such assistance mechanism of the surgical table 2 for helping medical staff dispose the tabletop 10 at a predetermined traverse position relative to the base 4, i.e. at a position someway, e.g. midway, between the first and second traverse positions relative to the base 4 is similar. In such another assistance mechanism, the tabletop traverse mechanism is considered as comprised in the tabletop drive mechanism, and the controller 200 controls the tabletop drive mechanism to cause the translational movement of the tabletop 10 relative to the base 4 in the longitudinal direction of the tabletop 10.

In variations to the illustrated embodiment, the surgical table may have none, or only either one, of the above-described assistance mechanisms.

In accordance with another aspect of the invention, a surgical table is provided with a system for monitoring the state of one or more electric actuators of the table.

In this embodiment, each of the first, second and third actuators 101, 102, 103 and the column actuator 801 is an electric actuator. As discussed above, the first, second and third actuators 101, 102, 103 and the column actuator 801 may be considered to be comprised in a drive mechanism, specifically a tabletop drive mechanism.

The surgical table 2 includes a power supply 400, which is an electrical power supply comprising one or more cells or batteries or a connection to the mains electrical power supply. Each of the controller 200, the user interface 300, the first, second and third actuators 101, 102, 103 and the column actuator 801 is electrically connected to the power supply 400 for drawing electrical power from the power supply 400 in order to operate.

The table 2 further comprises a memory 500, which preferably is non-volatile memory but may, in some embodiments, be volatile memory. In this embodiment, the memory 500 stores therein software for running by the controller 200 to control the mechanism height adjustment system and the column height adjustment system 800, as discussed above, and indications of respective currents drawn from the power supply 400 by each of the first, second and third actuators 101, 102, 103 and the column actuator 801.

The controller 200 comprises a current determiner for determining a current drawn from the power supply 400 by each of the first, second and third actuators 101, 102, 103 while the respective actuator 101, 102, 103 causes movement of the tabletop 10 relative to the column 8 and base 4, in the various manners described above. The current determiner also is for determining a current drawn from the power supply 400 by the column actuator 801 while the column actuator 801 causes movement of the tabletop 10 and mechanism 100 relative to the base 4, as also described above.

The controller 200 also comprises a recorder that is communicatively connected to the current determiner and the memory and is configured to record in the memory 500 an indication of a current determined by the current determiner in dependence on an output of the current determiner. By "communicatively connected to the current determiner", it is meant that the recorder is able to receive or determine the output of the current determiner. In practice, the controller 200 may comprise a (optionally unitary) microprocessor that is configured to carry out the operations of both the current determiner and the recorder.

The current determiner is configured to determine respective currents drawn from the power supply 400 by each of the actuators 101, 102, 103, 801 at respective different times, and the recorder is configured to record in the memory 500 respective indications of the determined respective currents.

Preferably, the controller 200 further comprises an overload determiner that is configured to determine when one or more of the actuators 101, 102, 103, 801 is, or has been, overloaded. In order to do this, the overload determiner either determines an output of one of the current determiner and the recorder, or accesses the respective indications of the determined respective currents stored in the memory 500. If the output of one of the current determiner and the recorder, or an indication of a current drawn from the power supply 400 by one of the actuators 101, 102, 103, 801 indicates that a current drawn from the power supply 400 by one of the actuators 101, 102, 103, 801 is greater than a predetermined threshold current for that actuator 101, 102, 103, 801, then the overload determiner determines that the actuator 101, 102, 103, 801 in question is overloaded, or has recently been overloaded. The table 2 includes an indicator, in the form of a visual or audible indicator, for indicating to a user when one of the actuators 101, 102, 103, 801 is overloaded. The controller 200 controls the indicator in dependence on an output of the overload determiner, which the controller 200 receives from the overload determiner.

The controller 200 preferably further comprises a calculator that is configured to calculate a cumulative current drawn from the power supply 400 by each of the actuators 101, 102, 103, 801 over a period of time. In order to do this, the calculator accesses the indications stored in the memory 500 to determine respective currents drawn from the power supply 400 by each of the actuators 101, 102, 103, 801 at respective different times, and then sums the respective currents drawn over the period of time from the power supply 400 by each of the actuators 101, 102, 103, 801. The period of time may be for example 1 hour, 24 hours, 7 days, 1 month, 1 year, etc.

Since the table 2 includes this system for recording the currents drawn from the power supply 400 by the electric actuators 101, 102, 103, 801, a maintenance person may access the memory 500 via a communication interface (not shown) of the table 2, to analyse the respective and cumulative currents drawn from the power supply 400 by the actuators 101, 102, 103, 801. By such analysis, the maintenance person may estimate how much wear has been endured by the actuators 101, 102, 103, 801, in order to determine when one or more of the actuators 101, 102, 103, 801 might be about to fail. Moreover, in embodiments such as the illustrated embodiment, in which the table 2 comprises an overload determiner and an indicator 600, a user of the table 2 is altered as to when one or more of the electric actuators 101, 102, 103, 801 is overloaded, in order that the user can avoid further straining of the one or more actuators 101, 102, 103, 801.

In accordance with another aspect of the invention, a surgical table is provided with a system for monitoring relative movements of first and second parts of the table, such as for future determination of relative movements of the first and second parts that have taken place.

The table 2 comprises a non-contact movement determiner for determining relative movements of various pairs of first and second relatively moveable parts of the table 2. For example, the movement determiner may be configured to determine rotational movement of the tabletop 10 relative to the column 8 about either or both of the transverse and longitudinal axes of the tabletop 10, and/or to determine translational movement of the tabletop 10 relative to the column 8 in the direction of the vertical axis of the table 2, and/or to determine translational movement of the tabletop 10 relative to the column 8 in the direction of the longitudinal axis of the tabletop 10, and/or to determine translational movement of the first part 81 of the column 8 relative to the base 4 in the direction of the vertical axis of the table 2.

By "non-contact" it is meant that the movement determiner is configured to determine the relative movements without being brought into contact with either of the relatively moveable parts, as compared to e.g. a mechanical trip-switch that needs to be brought into contact with a moving object in order to determined movement of the object.

In some embodiments, the movement determiner is communicatively connected to the controller 200 and is configured to determine relative movements of the various pairs of first and second relatively moveable parts on the basis of outputs (such as drive commands to the actuators 101, 102, 103, 801) of the controller 200, which the movement determiner is configured to intercept. In other embodiments, the table 2 may comprise respective non-contact sensors (not shown) (such as proximity sensors or accelerometers) for sensing relative positions of the various pairs of first and second relatively movable parts, and the movement determiner is communicatively connected to the sensors and is configured to determine relative movements of the various pairs of first and second relatively moveable parts on the basis of outputs of the sensors, which the movement determiner receives from the sensors.

The recorder is communicatively connected to the movement determiner and is configured to record in the memory 500 indications of relative movements of the various pairs of first and second relatively movable parts in dependence on outputs of the movement determiner, which the recorder receives from the movement determiner. Again, similarly to above, "communicatively connected to the movement determiner", it is meant that the recorder is able to receive or determine the output of the movement determiner. In practice, the controller 200 may comprise a (optionally unitary) microprocessor that is configured to carry out the operations of both the movement determiner and the recorder.

The movement determiner is configured to determine respective relative movements of the various pairs of first and second relatively movable parts at respective different times, and the recorder is configured to record in the memory 500 respective indications of the determined respective relative movements.

The table 2 preferably further comprises a second indicator 700 for indicating to a user, in dependence on a content of the memory 500, (a) a sequence of past relative movements of one or more of the various pairs of first and second relatively moveable parts, and/or (b) a last-performed relative movement of one or more of the various pairs of first and second relatively moveable parts. The second indicator may comprise a graphical display or a series of illuminable elements, for example. In order to do this, the controller 200 accesses the indications of relative movements stored in the memory 500, and then controls the second indicator 700 to provide an appropriate indication in dependence on the indications of relative movements stored in the memory 500.

Since the table 2 includes this system for recording the relative movements of the various pairs of first and second relatively moveable parts of the table 2, a maintenance person may access the memory 500 via a communication interface (not shown) of the table 2, to analyse the respective indications of relative movements stored in the memory 500. By such analysis, the maintenance person may be able to determine which pair of first and second relatively moveable parts of the table 2 were moving relative to each other prior to or during a failure of the table 2, which helps to determine a reason for such a table failure 2. Moreover, in embodiments such as the illustrated embodiment, in which the table 2 comprises an example of the above-described second indicator 700, a user of the table 2 or a maintenance person is more readily informed as to which pair of first and second relatively moveable parts of the table 2 were moving relative to each other prior to or during a failure of the table 2.

Various modifications can be made to the above-described embodiments without departing from the scope of the present invention, which is defined by the claims.

The invention claimed is:

1. A surgical table comprising:

a base for standing on a floor;

a column extending from the base;

a tabletop providing a patient support surface;

a mechanism coupling the tabletop to the column and for enabling rotational movement of the tabletop relative to the column about two orthogonal axes, wherein one of the two orthogonal axes is parallel to the longitudinal direction of the tabletop and the other of the two orthogonal axes is parallel to the transverse direction of the tabletop, the mechanism comprising a first frame connected to the tabletop and a second frame connected to the column and rotatably mounted on the first frame about an axis that is orthogonal to both longitudinal and transverse directions of the tabletop; and first and second actuators, each actuator being connected to a respective one of the frames for moving the respective frame about a respective one of the two orthogonal axes, wherein the first frame is connected to the column via the first actuator, and the second frame is connected to the column via the second actuator; and wherein the first actuator is rotatably connected to the column about a first axis and the second actuator is rotatably connected to the column about a second axis, wherein the second axis is orthogonal to the first axis.

2. A surgical table according to claim 1, wherein the first frame is connected to the first actuator by a first gimbal mechanism and the second frame is connected to the second actuator by a second gimbal mechanism.

3. A surgical table according to claim 2, wherein the first gimbal mechanism is configured to rotate the tabletop about an axis parallel to the transverse direction of the tabletop and the second gimbal mechanism is configured to rotate the tabletop about an axis parallel to the longitudinal direction of the tabletop.

4. A surgical table according to claim 1, wherein each of the first and second actuators is for moving both of the frames about a respective one of the two orthogonal axes.

5. A surgical table according to claim 1, wherein the total number of actuators via which the second frame is connected to the column is only one.

6. A surgical table according to claim 1, wherein one or each of the first and second actuators is connected to the respective frame via a universal joint.

7. A surgical table according to claim 1, wherein one or each of the first and second actuators is rotatably connected to the column about only a single axis.

8. A surgical table according to claim 1, wherein one of the first and second axes is parallel to the longitudinal direction of the tabletop and the other of the first and second axes is parallel to the transverse direction of the tabletop.

9. A surgical table according to claim 1, wherein each of the first and second actuators comprises a cylinder connected to one of the column and the respective frame, and an elongate part movably disposed within the cylinder and connected to the other of the column and the respective frame.

10. A surgical table according to claim 1, comprising first and second extensible stabilisers, wherein the first frame is connected to the column via the first extensible stabiliser in parallel with the first actuator, and the second frame is connected to the column via the second extensible stabiliser in parallel with the second actuator.

11. A surgical table according to claim 10, wherein the first and second actuators are connected to the respective first and second frames via respective first and second universal joints, and wherein the first and second extensible stabilisers are connected to the respective first and second frames via the respective first and second universal joints.

12. A surgical table according to claim 10, wherein the total number of extensible stabilisers via which the first frame is connected to the column is only two, and the total number of extensible stabilisers via which the second frame is connected to the column is only two.

13. A surgical table according to claim 1, wherein the first frame is connected to the column via the first actuator and via a third actuator in parallel to the first actuator.

14. A surgical table according to claim 13, wherein the total number of actuators via which the first frame is connected to the column is only two.

15. A surgical table according to claim 13, wherein the first and third actuators are connected to opposed sides of the column.

16. A surgical table according to claim 13, wherein each of the first and third actuators is connected to a respective one of two opposite end portions of the first frame.

17. A surgical table according to claim 13, wherein the third actuator is connected to the first frame via a universal joint.

18. A surgical table according to claim 13, wherein one or each of the first and third actuators is rotatably connected to the column about only a single axis.

19. A surgical table according to claim 13, wherein the first actuator is rotatably connected to the column about a first axis and the third actuator is rotatably connected to the column about a third axis, wherein the third axis is spaced from and parallel to the first axis.

20. A surgical table according to claim 13, wherein the third actuator comprises a cylinder connected to one of the column and the first frame, and an elongate part movably disposed within the cylinder and connected to the other of the column and the first frame.

21. A surgical table according to claim 13, wherein each of the first, second and third actuators is extendible, and extension of all of the first, second and third actuators increases the height of the mechanism thereby increasing a height of the tabletop above the column.

22. A surgical table comprising:

a base for standing on a floor;

a column extending from the base;

a tabletop providing a patient support surface; and a mechanism coupling the tabletop to the column and for enabling rotational movement of the tabletop relative to the column about two orthogonal axes, the mechanism comprising a first frame connected to the tabletop, a second frame rotatably mounted on the first frame, first and second extensible stabilisers, and first and second actuators disposed outside of both the first and second extensible stabilisers, each actuator being connected to a respective one of the frames for moving the respective frame about a respective one of the two orthogonal axes;

wherein the first frame is connected to the column via the first extensible stabiliser and the first actuator in parallel, and the second frame is connected to the column by the second extensible stabiliser and the second actuator in parallel; and wherein the first actuator is rotatably connected to the column about a first axis and the second actuator is rotatably connected to the column about a second axis, wherein the second axis is orthogonal to the first axis.

23. A surgical table according to claim 22, wherein the second frame is rotatably mounted on the first frame about an axis that is orthogonal to both longitudinal and transverse directions of the tabletop.

24. A surgical table according to claim 22, wherein one of the two orthogonal axes is parallel to a longitudinal direction of the tabletop and the other of the two orthogonal axes is parallel to a transverse direction of the tabletop.

25. A surgical table according to claim 22, wherein one or each of the first and second extensible stabilisers comprises a cylinder connected to one of the column and the respective frame, and an elongate part movably disposed within the cylinder and connected to the other of the column and the respective frame.

26. A surgical table according to claim 22, wherein one or each of the first and second actuators is rotatably connected to the column about only a single axis.

27. A surgical table according to claim 22, wherein one of the first and second axes is parallel to a longitudinal direction of the tabletop and the other of the first and second axes is parallel to a transverse direction of the tabletop.

28. A surgical table according to claim 22, wherein one or each of the first and second extensible stabilisers is rotatably connected to the column about only a single axis.

29. A surgical table according to claim 22, wherein the first extensible stabiliser is rotatably connected to the column about the first axis or an axis parallel to the first axis, and the second extensible stabiliser is rotatably connected to the column about the second axis or an axis parallel to the second axis.

30. A surgical table according to claim 22, wherein the first actuator is connected to the first frame via a first universal joint.

31. A surgical table according to claim 30, wherein the first extensible stabiliser is connected to the first frame via the first universal joint.

32. A surgical table according to claim 22, wherein the second actuator is connected to the second frame via a second universal joint.

33. A surgical table according to claim 32, wherein the second extensible stabiliser is connected to the second frame via the second universal joint.

34. A surgical table according to claim 1, wherein the column is of adjustable height.

35. A surgical table according to claim 1, wherein the first frame is connected to the tabletop via a tabletop traverse mechanism for enabling movement of the tabletop relative to the column in a selected longitudinal direction of the tabletop.

36. A surgical table comprising:

a base for standing on a floor;

a column extending from the base;

a tabletop providing a patient support surface; and a mechanism coupling the tabletop to the column and for enabling rotational movement of the tabletop relative to the column about two orthogonal axes, the mechanism comprising a first frame connected to the tabletop, a second frame rotatably mounted on the first frame, an extensible stabiliser, and first, second and third actuators disposed outside of the extensible stabiliser, each of the first and second actuators being connected to a respective one of the frames for moving the respective frame about a respective one of the two orthogonal axes;

wherein the first frame is connected to the column via the first and third actuators in parallel, and the second frame is connected to the column by the extensible stabiliser and second actuator in parallel; and wherein the total number of actuators via which the first frame is connected to the column is only two, and the total number of actuators via which the second frame is connected to the column is only one; and wherein the first actuator is rotatably connected to the column about a first axis and the second actuator is rotatably connected to the column about a second axis, wherein the second axis is orthogonal to the first axis.

37. A surgical table according to claim 36, wherein the second frame is rotatably mounted on the first frame about an axis that is orthogonal to both longitudinal and transverse directions of the tabletop.

38. A surgical table according to claim 36, wherein one of the two orthogonal axes is parallel to a longitudinal direction of the tabletop and the other of the two orthogonal axes is parallel to a transverse direction of the tabletop.

39. A surgical table according to claim 36, wherein one of the first and second axes is parallel to a longitudinal direction of the tabletop and the other of the first and second axes is parallel to a transverse direction of the tabletop.

40. A surgical table according to claim 36, wherein the third actuator is rotatably connected to the column about an axis parallel to the first axis.

41. A surgical table according to claim 36, wherein the extensible stabiliser is rotatably connected to the column about an axis parallel to the second axis.

42. A surgical table according to claim 36, wherein the first frame is connected to the first actuator by a first gimbal mechanism and the second frame is connected to the second actuator by a second gimbal mechanism.

43. A surgical table according to claim 36, wherein the first and third actuators are connected to the first frame by a first gimbal mechanism and the second frame and the extensible stabiliser are connected to the second actuator by a second gimbal mechanism.

44. A surgical table according to claim 42, wherein the first gimbal mechanism is configured to rotate the tabletop about an axis parallel to the transverse direction of the tabletop and the second gimbal mechanism is configured to rotate the tabletop about an axis parallel to the longitudinal direction of the tabletop.

* * * * *